US012618618B2

(12) United States Patent
Boreyko et al.

(10) Patent No.: US 12,618,618 B2
(45) Date of Patent: May 5, 2026

(54) PLANAR BRIDGING-DROPLET THERMAL DIODES

(71) Applicant: VIRGINIA TECH INTELLECTUAL PROPERTIES, INC., Blacksburg, VA (US)

(72) Inventors: Jonathan B. Boreyko, Blacksburg, VA (US); Mojtaba Edalatpour, Blacksburg, VA (US); Kevin R. Murphy, Blacksburg, VA (US); Ranit Mukherjee, Blacksburg, VA (US)

(73) Assignee: VIRGINIA TECH INTELLECTUAL PROPERTIES, INC., Blacksburg, VA (US)

( * ) Notice: Subject to any disclaimer, the term of this patent is extended or adjusted under 35 U.S.C. 154(b) by 51 days.

(21) Appl. No.: 18/012,591

(22) PCT Filed: Jun. 25, 2021

(86) PCT No.: PCT/US2021/039106
§ 371 (c)(1),
(2) Date: Dec. 22, 2022

(87) PCT Pub. No.: WO2021/263114
PCT Pub. Date: Dec. 30, 2021

(65) Prior Publication Data

US 2023/0251045 A1 Aug. 10, 2023

Related U.S. Application Data

(60) Provisional application No. 63/044,135, filed on Jun. 25, 2020.

(51) Int. Cl.
*F28D 15/04* (2006.01)
*F25D 19/00* (2006.01)

(52) U.S. Cl.
CPC ..... *F28D 15/046* (2013.01); *F25D 19/006* (2013.01)

(58) Field of Classification Search
CPC ... F28F 2013/008; F28F 13/04; F28D 19/006; F28D 15/046; F28D 15/0233;
(Continued)

(56) References Cited

U.S. PATENT DOCUMENTS 4,377,198 A 3/1983 Welling et al.
8,716,689 B2 5/2014 Chen et al.
(Continued)

OTHER PUBLICATIONS

Edalatpour, M. Bridging-Droplet Thermal Diodes. Advanced Functional Martials. Aug. 18, 2020, vol. 30, No. 43. entire document.
(Continued)

*Primary Examiner* — Nelson J Nieves
(74) *Attorney, Agent, or Firm* — John S. Sears; Lex Generalis, LLC

(57) ABSTRACT

This disclosure provides a thermal diode including a first plate having a first surface defining a wick structure. The thermal diode can include a second plate having a smooth surface facing the wick structure, the smooth surface and the wick structure defining a chamber for accommodating a phase-change liquid. The thermal diode also can include a separator positioned between the first plate and the second plate to separate the wick structure from the smooth surface by a gap that is less than a capillary length of the phase-change liquid.

15 Claims, 10 Drawing Sheets

(58) Field of Classification Search
CPC ..... F28D 15/02; F28D 15/04; F28D 15/0208; F28D 2015/0225
See application file for complete search history.

(56) References Cited

U.S. PATENT DOCUMENTS

| | | | | |
|---|---|---|---|---|
| 2011/0016886 | A1 | 1/2011 | Ghoshal et al. | |
| 2012/0012804 | A1* | 1/2012 | Chen | H01L 23/427 165/104.21 |
| 2012/0192574 | A1 | 8/2012 | Ghoshal et al. | |
| 2017/0125866 | A1 | 5/2017 | Zhou et al. | |
| 2018/0073814 | A1* | 3/2018 | Zhou | F28D 15/0233 |
| 2021/0262737 | A1* | 8/2021 | North | H01L 23/427 |
| 2023/0332839 | A1* | 10/2023 | Megaridis | F28D 15/04 |
| 2023/0417492 | A1* | 12/2023 | Kluge | F28D 15/02 |
| 2024/0133636 | A1* | 4/2024 | Fujita | H01L 23/3731 |
| 2024/0142179 | A1* | 5/2024 | Abe | F28D 15/0283 |

OTHER PUBLICATIONS

Boreyko, et al., Self-Propelled Dropwise Condensate on Superhydrophobic Surfaces, Phys. Rev. Lett., vol. 103, Oct. 30, 2009.
Boreyko, et al., "Planar jumping-drop thermal diodes," Appl. Phys. Lett., vol. 99, 234105 , Dec. 9, 2011.
Boreyko, et al., "Vapor chambers with jumping-drop liquid return from superhydrophobic condensers," Int. J. Heat Mass Transfer, 61, Jan. 28, 2013.
Chen, et al., "Effects of working fluids on the performance of a bi-directional thermodiode for solar energy utilization in buildings," Sol. Energy, 83, pp. 409-419, Oct. 5, 2008.
Dames, C., "Solid-state thermal recti cation with existing bulk materials," ASME J. Heat Transfer, 131:061301, Mar. 31, 2009.
J. Le Fevre, et al., "A theory of heat transfer by dropwise condensation," In Proceedings of the Third International Heat Transfer Conference, pp. 362-375, 1966.
Miljkovic, et al., "Jumping droplets electronics cooling: Promise versus reality," Appl. Phys. Lett., 116:203701, May 18, 2020.
Miljkovic, et al., "Self-assembled liquid bridge confined boiling on nanoengineered surfaces," International Journal of Heat and Mass Transfer, vol. 133, Dec. 11, 2018.
Groll, et al., "Development of a liquid-trap heat pipe thermal diode," J. Spacecraft, vol. 16 1979.
Hengeveld, et al., "Review of modern spacecraft thermal control technologies," HVAC&R Res., vol. 16. 2010.
Jezowski, et al., "Heat Flow asymmetry on a junction of quartz with graphite," Phys. Status Solidi A, vol. 47, 1978.
Goodson, et al., "Tunable, passive thermal regulation through liquid to vapor phase change," Appl. Phys. Lett., 115:254102, Dec. 17, 2019.
Marek, et al., "Analysis of the evaporation coefficient and the condensation coefficient of water," Int. J. Heat Mass Transfer, 44, pp. 39-53, 2001.
Marucha, et al., "Heat Flow recti cation in inhomogeneous GaAs," Phys. Status Solidi A, 31, 1975.
Mohamad, et al., "Integrated solar collector-storage tank system with thermal diode," Sol. Energy, 61, pp. 211-218, May 22, 1997.
Miljkovic, et al., "Jumping-droplet electronics hot-spot cooling," Appl. Phys. Lett., 110:123107, Mar. 23, 2017.
McCarthy, et al., "Self-Organization of Microscale Condensate for Delayed Flooding of Nanostructured Superhydrophobic Surfaces," ACS Appl. Mater. Interfaces, 8 Feb. 8, 2016.
Pallecchi, et al., "A thermal diode and novel implementation in a phase-change material," Mater. Horiz., 2:125 2015.
Varanasi, et al., "Stable Dropwise Condensation for Enhancing Heat Transfer via the Initiated Chemical Vapor Deposition (iCVD) of Grafted Polymer Films," Adv. Mater., 26 2014.
Wang, et al., "Scalable graphene coatings for enhanced condensation heat transfer," Nano Lett., 15 Mar. 31, 2015.
Pugsley, et al., "Theoretical and experimental analysis of a horizontal planar liquid-vapour thermal diode (PLVTD)," Int. J. Heat Mass Transfer, 144:118660 Sep. 6, 2019.
Rose, et al., "Dropwise condensation theory and experiment: a review," Proc. Inst. Mech. Eng., Part A, 216 Oct. 16, 2001.
Marco Aurélio dos Santos Bernardes, "Experimental evidence of the working principle of thermal diodes based on thermal stress and thermal contact conductance thermal semiconductors," Int. J. Heat Mass Transfer, 73 Feb. 6, 2014.
Sawaki, et al., "Thermal rectification in bulk materials with asymmetric shape," Appl. Phys. Lett., 98:081915, 2011.
Supowit, et al., "Designer uid performance and inclination angle e ects in a at grooved heat pipe," Appl. Therm. Eng., 101, Feb. 20, 2016.
Torresin, et al., "Flow condensation on copper-based nanotextured superhydrophobic surfaces," Langmuir, 29:840848, Dec. 19, 2012.
Chao, et al., "Solid-state thermal diode with shape memory alloys," Int. J. Heat Mass Transfer, 93, Nov. 11, 2015.
Oliveira, et al., "Characterization of thermal diode panels for use in the cooling season in buildings," Energy Build., 34, Jun. 15, 2001.
Chen, et al., "Hotspot cooling with jumping-drop vapor chambers," Appl. Phys. Lett., 110:141601, Apr. 3, 2017.
Wong, et al., "Experimental and theoretical study of a water-vapor chamber thermal diode," Int. J. Heat Mass Transfer, 138, Apr. 15, 2019.

* cited by examiner

PLANAR BRIDGING-DROPLET THERMAL DIODES

CROSS-REFERENCE TO RELATED APPLICATIONS

This application is the 35 U.S.C. § 371 national stage application of PCT Application No. PCT/US2021/039106, filed Jun. 25, 2021, where the PCT claims priority to U.S. Provisional Patent Application No. 63/044,135, entitled "Planar Bridging-Droplet Thermal Diodes," filed Jun. 25, 2020, both of which are incorporated by reference herein in their entireties.

TECHNICAL FIELD

This disclosure relates to heat rectifying devices, and, in particular, to thermal diodes.

DESCRIPTION OF THE RELATED TECHNOLOGY

Thermal diodes are devices that conduct heat more efficiently in one path compared to that in the opposite path. Thermal diodes are desirable for the smart thermal management of heat producing devices, such as, for example, electronic devices and spacecraft, as the thermal diodes can effectively dump onboard heat while also shielding from external heat sources.

SUMMARY

In one aspect of the disclosure, a thermal diode includes a smooth condensing surface, a wicked evaporating surface substantially parallel to the condensing surface, wherein the wicked evaporating surface and the condensing surface are separated by a predetermined distance to form a chamber therebetween, and a phase-change liquid within the chamber, where the predetermined distance between the wicked evaporating surface and the condensing surface is less than or equal to a critical distance, and where the critical distance is defined as the largest distance between the wicked evaporating surface and the condensing surface at which, when a droplet of the phase-change liquid condenses on the condensing surface, the droplet can grow to a height to bridge the gap between the wicked evaporating surface and the condensing surface.

In some embodiments, the thermal diode further includes an insulating gasket separating the wicked evaporating surface and the condensing surface and defining the predetermined distance therebetween and forming insulating walls on edges of the chamber. In some embodiments, one or both of the wicked evaporating surface and the condensing surface comprise copper, silicon, aluminum, steel, titanium, or a combination thereof. In some embodiments, the phase-change liquid comprises water or a mixture thereof. In some embodiments, the smooth condensing surface comprises a hydrophobic coating. In some embodiments, the hydrophobic coating comprises a hydrophobic thiol coating or a hydrophobic polymer coating. In some embodiments, the smooth condensing surface has a surface roughness about 5 nm, about 1 nm, about 0.5 nm, or less.

In some embodiments, the wicked evaporating surface comprises a plurality of micro-scale pillars, micro-scale dimples, a micro-mesh, or a sintered copper surface. In some embodiments, the thermal diode has a diodicity of at least 10, at least 20, at least 40, or at least 60 and up to about 150 or 300 at a temperature of about 20° C. to about 90° C. In some embodiments, a diodicity of the thermal diode varies by 25% or less with changes in orientation of the thermal diode in relation to the gravitational field. In some embodiments, a shortest straightline distance between the smooth condensing surface and the wicked evaporating surface is about 500 μm or less, about 300 μm or less, or about 100 μm or less. In some embodiments, the thermal diode has an aspect ratio defined as either a length or a width over a height of greater than 2, such that the thermal diode is essentially two-dimensional.

In some embodiments, the gasket provides fluidic sealing of the chamber and prevents or reduces thermal conduction during operation of the thermal diode. In some embodiments, the thermal diode is attached to a body selected from at least one of an electronic device, a biological system, a medical implant, a dwelling, a construction material, a window, a motorized land or water vehicle, a satellite, an aerospace vehicle, a spacecraft, a chemical processing plant, a power plant, a mechanical machine, an electromechanical system, an energy harvesting device, a nuclear reactor, and an energy storage system.

In another aspect of the disclosure, a method of rectifying heat flow includes providing a thermal diode according to any aspect discussed herein.

In yet another aspect of the disclosure a thermal diode includes a first plate having a first surface defining a wick structure, a second plate having a smooth surface facing the wick structure, the smooth surface and the wick structure defining a chamber for accommodating a phase-change liquid, and a separator positioned between the first plate and the second plate to separate the wick structure from the smooth surface by a gap that is less than a capillary length of the phase-change liquid.

In some embodiments, the separator is a gasket that seals the chamber and that extends along the perimeters of the first plate and the second plate. In some embodiments, the gap is less than an order of magnitude less than the capillary length. In some embodiments, the smooth surface comprises a hydrophobic coating. In some embodiments, the hydrophobic coating comprises a hydrophobic thiol coating or a hydrophobic polymer coating. In some embodiments, the smooth surface is devoid of nanostructures that have a height of more than 100 nm. In some embodiments, the smooth surface is devoid of nanostructures that have a pitch of more than 500 nm. In some embodiments, the wick structure includes an array of pillars. In some embodiments, a height of the array of pillars is 400 μm to 800 μm. In some embodiments, an average center-to-center pitch between adjacent pillars in the array of pillars is 100 μm to 300 μm. In some embodiments, a plurality of pillars from the array of pillars have a rectangular cross-section. In some embodiments, a plurality of pillars from the array of pillars have a circular cross-section. In some embodiments, the wick structure includes a sintered first surface.

In some embodiments, the gap has a magnitude that allows for a condensed droplet of the phase-change liquid on the smooth surface to grow to a height to bridge between the smooth surface and the wick structure. In some embodiments, the condensed droplet has a contact angle that is greater than 90 degrees but less than 125 degrees. In some embodiments, the gap has a magnitude of up to 350 μm. In some embodiments, in a forward mode of operation, the first plate is thermally coupled with a heat source. In some embodiments, in a reverse mode of operation, the second plate is thermally coupled with a heat source. In some embodiments, one or both of the wick structure and the smooth surface comprise copper, silicon, aluminum, steel, or a combination thereof. In some embodiments, the phase-change liquid comprises water or a mixture thereof. In some embodiments, the smooth surface has a surface roughness about 5 nm, about 1 nm, about 0.5 nm, or less. In some embodiments, the thermal diode has a diodicity of at least 10, at least 20, at least 40, or at least 60 and up to about 150 or 300 at a temperature of about 20° C. to about 90° C. In some embodiments, a diodicity of the thermal diode varies by 25% or less with changes in orientation of the thermal diode in relation to the gravitational field.

BRIEF DESCRIPTION OF THE DRAWINGS

Like reference numbers and designations in the various drawings indicate like elements.

DETAILED DESCRIPTION

Figure 1:
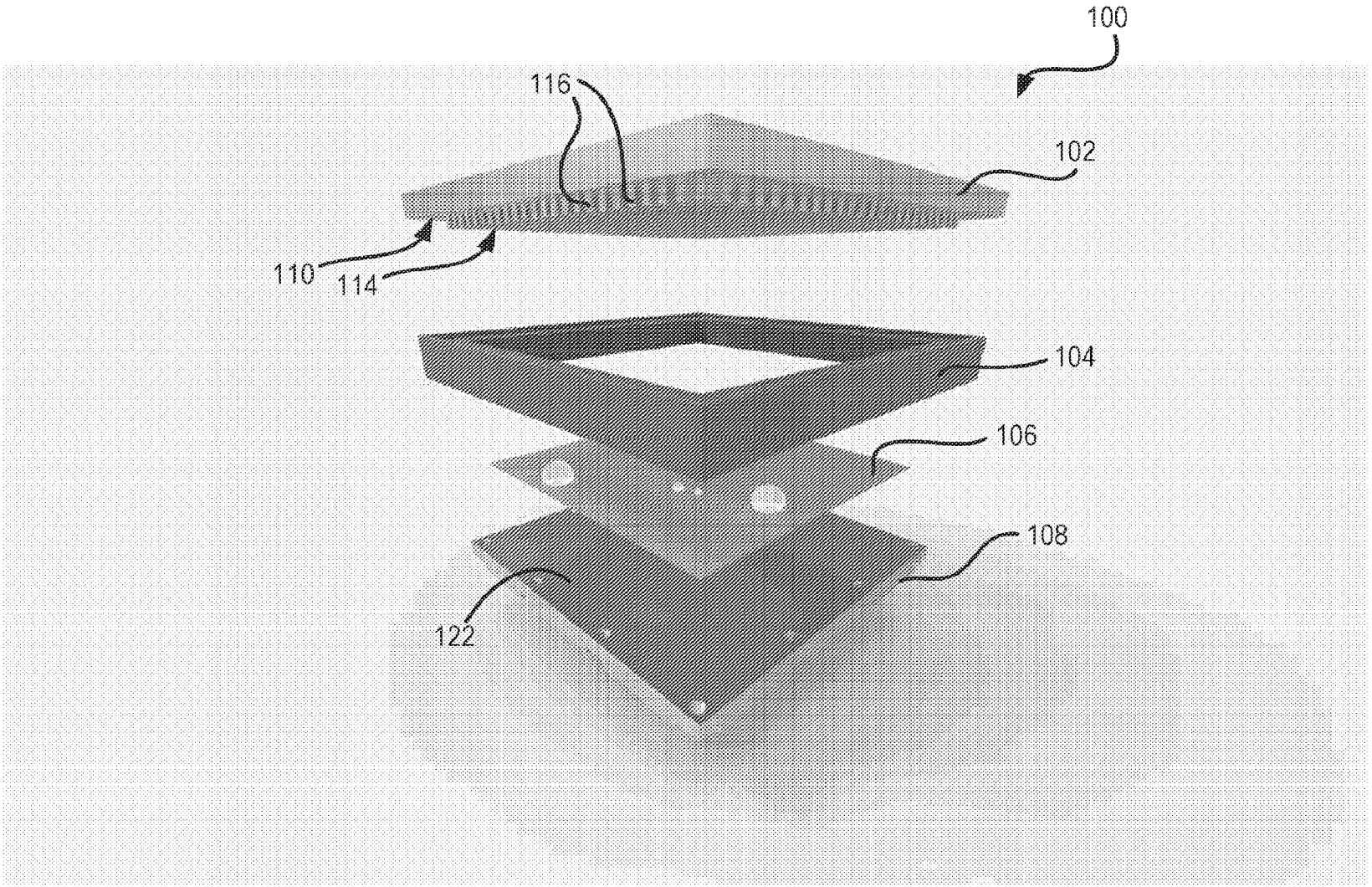
FIG. 1 shows an exploded view of an example thermal diode.

The various concepts introduced above and discussed in greater detail below may be implemented in any of numerous ways, as the described concepts are not limited to any particular manner of implementation. Examples of specific implementations and applications are provided primarily for illustrative purposes.

As will be apparent to those of skill in the art upon reading this disclosure, each of the individual embodiments described and illustrated herein has discrete components and features which may be readily separated from or combined with the features of any of the other several embodiments without departing from the scope or spirit of the present disclosure.

Any recited method can be carried out in the order of events recited or in any other order that is logically possible. That is, unless otherwise expressly stated, it is in no way intended that any method or aspect set forth herein be construed as requiring that its steps be performed in a specific order. Accordingly, where a method claim does not specifically state in the claims or descriptions that the steps are to be limited to a specific order, it is no way intended that an order be inferred, in any respect. This holds for any possible non-express basis for interpretation, including matters of logic with respect to arrangement of steps or operational flow, plain meaning derived from grammatical organization or punctuation, or the number or type of aspects described in the specification.

All publications mentioned herein are incorporated herein by reference to disclose and describe the methods and/or materials in connection with which the publications are cited. The publications discussed herein are provided solely for their disclosure prior to the filing date of the present application. Nothing herein is to be construed as an admission that the present invention is not entitled to antedate such publication by virtue of prior invention. Further, the dates of publication provided herein can be different from the actual publication dates, which can require independent confirmation.

While aspects of the present disclosure can be described and claimed in a particular statutory class, such as the system statutory class, this is for convenience only and one of skill in the art will understand that each aspect of the present disclosure can be described and claimed in any statutory class.

It is also to be understood that the terminology used herein is for the purpose of describing particular aspects only and is not intended to be limiting. Unless defined otherwise, all technical and scientific terms used herein have the same meaning as commonly understood by one of ordinary skill in the art to which the disclosed compositions and methods belong. It will be further understood that terms, such as those defined in commonly used dictionaries, should be interpreted as having a meaning that is consistent with their meaning in the context of the specification and relevant art and should not be interpreted in an idealized or overly formal sense unless expressly defined herein.

It should be noted that ratios, concentrations, amounts, and other numerical data can be expressed herein in a range format. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed. Ranges can be expressed herein as from "about" one particular value, and/or to "about" another particular value. Similarly, when values are expressed as approximations, by use of the antecedent "about," it will be understood that the particular value forms a further aspect. For example, if the value "about 10" is disclosed, then "10" is also disclosed.

When a range is expressed, a further aspect includes from the one particular value and/or to the other particular value. For example, where the stated range includes one or both of the limits, ranges excluding either or both of those included limits are also included in the disclosure, e.g., the phrase "x to y" includes the range from 'x' to 'y' as well as the range greater than 'x' and less than 'y'. The range can also be expressed as an upper limit, e.g., 'about x, y, z, or less' and should be interpreted to include the specific ranges of 'about x', 'about y', and 'about z' as well as the ranges of 'less than x', less than y', and 'less than z'. Likewise, the phrase 'about x, y, z, or greater' should be interpreted to include the specific ranges of 'about x', 'about y', and 'about z' as well as the ranges of 'greater than x', greater than y', and 'greater than z'. In addition, the phrase "about 'x' to 'y'", where 'x' and 'y' are numerical values, includes "about 'x' to about 'y'".

It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a numerical range of "about 0.1% to 5%" should be interpreted to include not only the explicitly recited values of about 0.1% to about 5%, but also include individual values (e.g., about 1%, about 2%, about 3%, and about 4%) and the sub-ranges (e.g., about 0.5% to about 1.1%; about 5% to about 2.4%; about 0.5% to about 3.2%, and about 0.5% to about 4.4%, and other possible sub-ranges) within the indicated range.

As used herein, the terms "about," "approximate," "at or about," and "substantially" mean that the amount or value in question can be the exact value or a value that provides equivalent results or effects as recited in the claims or taught herein. That is, it is understood that amounts, sizes, formulations, parameters, and other quantities and characteristics are not and need not be exact, but may be approximate and/or larger or smaller, as desired, reflecting tolerances, conversion factors, rounding off, measurement error and the like, and other factors known to those of skill in the art such that equivalent results or effects are obtained. In some circumstances, the value that provides equivalent results or effects cannot be reasonably determined. In such cases, it is generally understood, as used herein, that "about" and "at or about" mean the nominal value indicated ±10% variation unless otherwise indicated or inferred. In general, an amount, size, formulation, parameter or other quantity or characteristic is "about," "approximate," or "at or about" whether or not expressly stated to be such. It is understood that where "about," "approximate," or "at or about" is used before a quantitative value, the parameter also includes the specific quantitative value itself, unless specifically stated otherwise.

Prior to describing the various aspects of the present disclosure, the following definitions are provided and should be used unless otherwise indicated. Additional terms may be defined elsewhere in the present disclosure.

As used herein, "comprising" is to be interpreted as specifying the presence of the stated features, integers, steps, or components as referred to, but does not preclude the presence or addition of one or more features, integers, steps, or components, or groups thereof. Moreover, each of the terms "by", "comprising," "comprises", "comprised of," "including," "includes," "included," "involving," "involves," "involved," and "such as" are used in their open, non-limiting sense and may be used interchangeably. Further, the term "comprising" is intended to include examples and aspects encompassed by the terms "consisting essentially of" and "consisting of." Similarly, the term "consisting essentially of" is intended to include examples encompassed by the term "consisting of.

As used herein, the term "and/or" includes any and all combinations of one or more of the associated listed items. Expressions such as "at least one of," when preceding a list of elements, modify the entire list of elements and do not modify the individual elements of the list.

As used in the specification and the appended claims, the singular forms "a," "an" and "the" include plural referents unless the context clearly dictates otherwise. Thus, for example, reference to "a proton beam degrader," "a degrader foil," or "a conduit," includes, but is not limited to, two or more such proton beam degraders, degrader foils, or conduits, and the like.

The various concepts introduced above and discussed in greater detail below may be implemented in any of numerous ways, as the described concepts are not limited to any particular manner of implementation. Examples of specific implementations and applications are provided primarily for illustrative purposes.

As used herein, the terms "optional" or "optionally" means that the subsequently described event or circumstance can or cannot occur, and that the description includes instances where said event or circumstance occurs and instances where it does not. Unless otherwise specified, temperatures referred to herein are based on atmospheric pressure (i.e. one atmosphere).

A thermal diode is a device that conducts heat in one direction while impeding the conduction of heat in the opposite direction. The thermal diode can be employed in applications where conduction of heat is desired in one direction, but not in the opposite direction. For example, the thermal diode can be used in spacecraft or with electronic packaging where it is desirable to transfer heat away from internal heat sources, but also to shield the internal heat sources from external heat. The heat sources can include, for example, an electronic device, a biological system, a medical implant, a dwelling, a construction material, a window, a motorized land or water vehicle, a satellite, an aerospace vehicle, a spacecraft, a chemical processing plant, a power plant, a mechanical machine, an electromechanical system, an energy harvesting device, a nuclear reactor, and an energy storage system.

Thermal diodes can be broadly categorized as solid-state thermal diodes or phase-change thermal diodes. Solid state thermal diodes operate by exploiting asymmetries in thermal expansion, thermal contact, or temperature-dependent thermal conductivities. Phase-change thermal diodes on the other hand utilize latent heat of vaporization in the forward direction to affect rectification. Solid state diode use is limited by their low diodicity ($\eta \sim 1$), however phase-change thermal diodes can exhibit diodicities one or two orders of magnitude higher than that of solid state thermal diodes.

Phase-change thermal diodes can include thermosyphons, asymmetric heat pipes, and jumping-droplet vapor chambers. Thermosyphons are vertically oriented hollow containers that are partially filled with liquid. In the forward mode of operation, steam ascends by buoyant convection and condenses at the top of the container. The condensate then slides back to the bottom reservoir by gravity, enabling continuous phase-change heat transfer. Thermosyphons are commonly used to reduce the nocturnal losses of solar water heaters or in the support structures of oil pipelines to keep the underlying permafrost frozen. However, the dependence of thermosyphons on gravity precludes their use for spacecraft or any systems requiring orientation-independence.

Liquid-trap heat pipes employ a trapping reservoir on one end, such that condensate can only wick back to the evaporator in one direction. Asymmetric heat pipes offer a large diodicity of $\eta \approx 100$, but the resulting 1D heat transfer is ineffective for managing large, 3D systems. While placing an array of directional heat pipes into a wall panel solves the dimensionality problem, this is both complex and decreases the effective diodicity to $\eta \sim 1-10$.

When a condenser exhibits a superhydrophobic nanostructure, microscopic condensate can spontaneously jump several millimeters into the air during coalescence events. Jumping-droplet thermal diodes exploit this effect by placing a superhydrophobic condenser opposite a wicked evaporator, such that jumping-droplet liquid return enables continuous phase-change heat transfer in the forward mode. Dryout occurs in the reverse mode, as the heat source is now on the superhydrophobic side, and the liquid is trapped within the wick. However, the nanostructure is notorious for not being durable under prolonged exposure to steam. Even when ignoring the durability issue, the superhydrophobic condensers are prone to flooding when exposed to high supersaturations, which inhibits the jumping-droplet effect.

Therefore, the jumping-droplet thermal diode remains purely academic, due to the fragility of the superhydrophobic surface.

In summary, the above discussed phase-change thermal diodes are either constrained by gravitational dependence, poor scalability, or low durability. The planar bridging-droplet thermal diode discussed herein is capable of a diodicity of at least 11=85 and as much as 300. The thermal diode utilizes a smooth condenser instead of the fragile superhydrophobic one used in jumping droplet thermal diodes. While the switch to a smooth condenser does preclude jumping-droplet liquid return, it instead promotes bridging-droplet liquid return to the wicked evaporator by using a thin micrometric gap between the plates. In some examples, the smooth condenser can be hydrophobic (or weakly hydrophilic). Liquid bridge confined boiling (LBCB) is substantively different from the bridging-droplet thermal diode presented herein in at least four respects: 1) LBCB uses a superhydrophobic surface, 2) LBCB employs a single liquid bridge at a fixed hot spot, 3) LBCB requires boiling, and 4) LBCB is orientation-dependent (cold side down). In the diode discussed herein placing the smooth plate and the wicked plate in parallel to comprise a vapor chamber results in an advanced material system that exhibits emergent thermophysical properties not achievable by any traditional types of thermal diodes. Moreover, bridging-droplet diode can be durable for practical implementation while retaining the attractive features of orientation-independence and scalability.

FIG. 1 shows an exploded view of an example thermal diode 100. The thermal diode 100 includes a first plate 102, a second plate 108, and a separator 104 positioned between the first plate 102 and the second plate 108. The first plate 102 (also referred to herein as evaporator plate) and the second plate 108 (also referred to as a condenser plate) can be formed of metals such as, for example, copper, aluminum, steel, titanium, or a combination thereof. The separator 104 can be positioned along the perimeters of the first plate 102 and the second plate 108. The separator 104 can not only provide a seal to a chamber formed between the first plate 102 and the second plate 108 but can also maintain a desired distance or gap between the first plate 102 and the second plate 108. The separator 104 also can be a thermal insulator. This reduces thermal conduction between the first plate 102 and the second plate 108 through the separator 104.

The first plate 102 can have a first surface 110 and a second surface 112, opposite the first surface 110. The first plate 102 is positioned such that the first surface 110 (also referred to as a wicked evaporating surface) faces the second plate 108, and is substantially parallel to the second plate 108. The first surface 110 defines a wick structure 114 that extends outwardly from the first plate 102. The wick structure 114 can include an array of pillars 116. In some examples, the wick structure 114 can instead or in addition include a micro-mesh or a sintered first surface 110. For example, a micro-mesh can be adhered to at least a portion of the first surface 110. The material(s) of the micro-mesh can be same as the material(s) of the first plate 102, but in some other instances may include material other than those used to forming the first plate 102. In some examples, the micro-mesh can be formed by interlacing wires or interlocking metal links. In case of a wire micro-mesh, the micro-mesh can have a density of 100 wires per inch in each direction, or 300 wires per inch in each direction, or up to 1000 wires per inch in each direction. The sintered first surface 110 can be formed, for example, by depositing metal particles on the first surface 110 and heating the metal particles close to the melting point of the metal, causing the metal particles to bond together on the first surface 110. The bonded metal particles can form pores therebetween and the sintered structure can behave as a wick.

Figure 2:
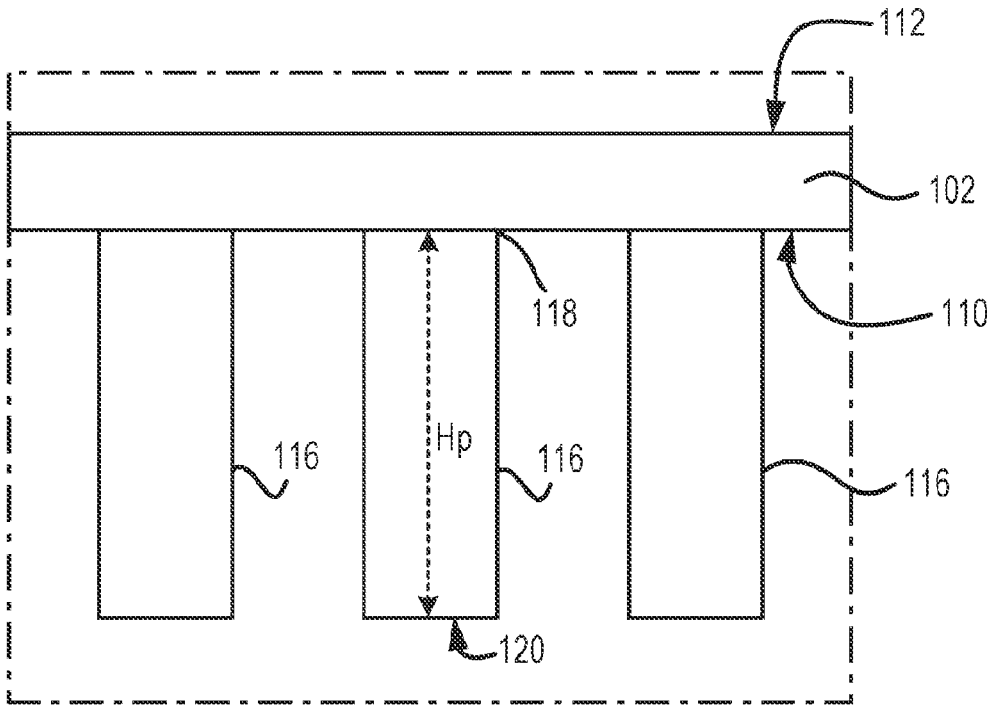
FIGS. 2 and 3 show a side view and a bottom view, respectively, of a portion of the example wick structure of the thermal diode shown in FIG. 1.
Figure 3:
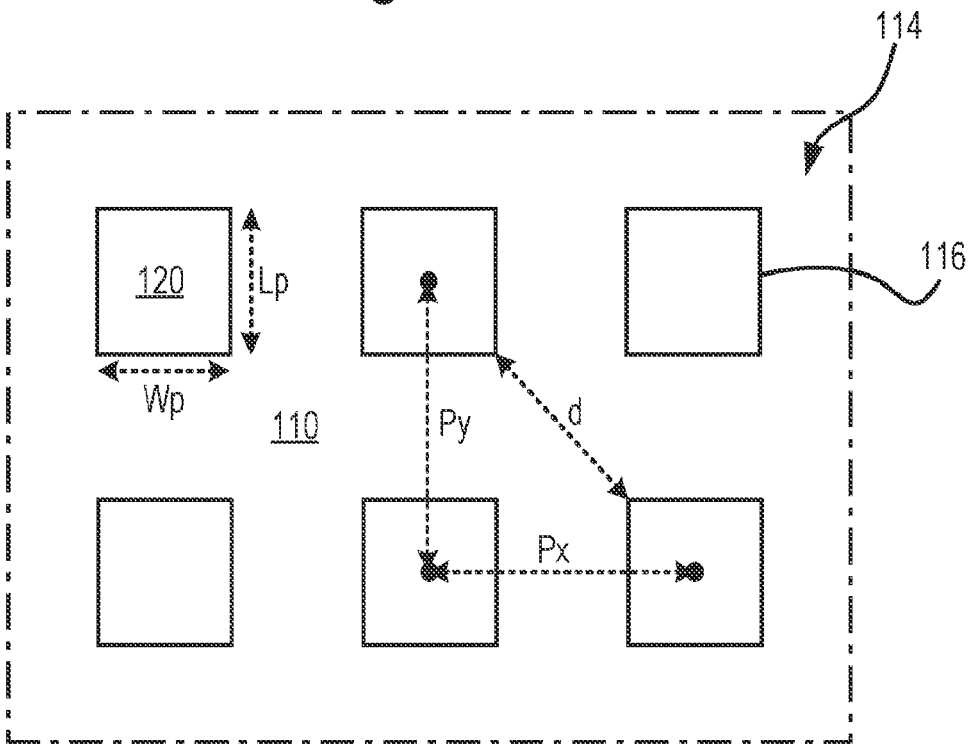

FIGS. 2 and 3 show a side view and a bottom view, respectively, of a portion of the example wick structure 114. In particular, FIGS. 2 and 3 show the example wick structure 114 including the array of pillars 116. The array of pillars 116 are arranged in a grid fashion in rows and columns. In the example shown in FIGS. 2 and 3, the array of pillars 116 in each row and column are aligned. In some other examples, the pillars 116 in adjacent rows or columns can be staggered. Staggering the pillars 116 can help reduce the distance between diagonal pillars 116, and in some instances improve the wicking efficiency of the wick structure 114. Two adjacent pillars 116 in a row (or in the x-direction) can have a center-to-center pitch denoted by 'Px' and two adjacent pillars 116 in a column (or in the y-direction) can have a center-to-center pitch denoted by 'Py'. In some examples, in particularly where the pillars 116 are arranged in a regular grid fashion, the center-to-center pitch Px can be equal to the center-to-center pitch Py. Where the pillars 116 are not regularly arranged, such as for example, when the pillars 116 are arranged in a staggered manner, Px may be unequal to Py. In some instance, the average center-to-center pitch can be about 50 μm to about 400 μm.

The pillars 116 can have a height 'Hp' measured from a base 118 to a top surface 120 of the pillar 116. The base of the pillar can be coplanar with the first surface 110 of the first plate 102. The height Hp of all the pillars 116 in the wick structure 114 can be substantially equal. That is, the height Hp of the pillars 116 can be within about 10% of the average height of the pillars 116. The average height of the pillars 116 can be between about 100 μm to about 1000 μm, or about 400 μm to about 800 μm, or about 600 μm. The pillars can have a width 'Wp' and a length 'Lp' measured along a cross-sectional plane that is normal to a longitudinal axis that extends along the height of the pillars 116. In some examples, the pillars 116 can have a square shaped cross-section, in which case the width Wp is substantially equal to the length Lp. However, the shape of the cross-section of the pillars 116 can be circular, elliptical, or polygonal (regular or irregular). In some instances, the width Wp of the pillars 116 can be between about 30 μm and about 200 μm. The width Wp and the length Lp can correspond to any cross-sectional shape and not just the rectangular or square cross-sectional shape shown in FIG. 3.

The pillars 116, in some examples, can be milled from a metal block that forms the first plate 102. The first surface 110 of the first plate 102 can be milled to a depth equal to the desired height of the pillars 116. Upon completion of the milling operation, the wick structure 114 including the pillars 116 are formed that are integral with the first plate 102. In some other instances, the pillars 116 can be formed by metal embossing, or other processes that can form micron sized features on the first plate 102.

Referring again to FIG. 1, the thermal diode 100 includes the second plate 108 that includes an inner surface 122 that faces the wick structure 114. The inner surface 122 (also referred to as a smooth condensing surface) of the second plate 108 can be a hydrophobic surface, however in some examples, inner surface 122 may not be hydrophobic (and can be weakly hydrophilic). A hydrophobic surface can be referred to as a liquid repelling surface or a low surface energy surface that resists wetting. In some examples, the inner surface 122 can be hydrophobic but not superhydrophobic. In particular, the hydrophobicity of the inner surface 122 can be described in relation to a contact angle of water on the inner surface 122, which contact angle can be in the range of 90 degrees to 125 degrees. Most superhydrophobic surfaces have a contact angle that is greater than 125 degrees, while most weakly hydrophilic surfaces have a contact angle that is less than 90 degrees. Furthermore, the inner surface 122 can a smooth surface. Some superhydrophobic surfaces have a roughness that is, in part, contributed by nanostructures that are formed on inner surface 122 of the second plate 108. As an example, the jumping-droplet thermal diode discussed above includes a superhydrophobic surface that includes nano structures that have a height of 100 nm or more and have a pitch (center-to-center nano structure distance) of more than 500 nm. These nanostructures are then coated with a hydrophobic film or coating, which results in creating Cassie air pockets between the nanostructures. This contributes to the high hydrophobicity of the superhydrophobic rough surface. The inner surface 122 of the second plate 108 on the other hand is a smooth surface and is not processed to intentionally include nanostructures. Any nanostructures present are incidental to forming the second plate 108 at the manufacturer and may not include nanostructures that have a height of 100 nm or more or have a pitch of 500 nm or more. In some examples, the smooth hydrophobic inner surface 122 can have a surface roughness of about 5 nm, about 1 nm, about 0.5 nm or less. In particular, these numerical values can represent the height of the nanostructures formed on the inner surface 122 and are substantially smaller than those associated with superhydrophobic surfaces.

In some examples, the inner surface 122 can be polished to remove roughness resulting in a smooth surface. In instances, a hydrophobic coating 106 can be deposited over the inner surface 122. This hydrophobic coating can include, for example, hydrophobic polymer coatings, hydrophobic thiol coatings, etc. As the surface of the inner surface 122 is smooth, the hydrophobic coating can be reliably adhered to the inner surface 122. This is unlike the superhydrophobic rough surface, on which adhering a hydrophobic coating can be challenging. Thus, the life and reliability of the hydrophobic inner surface 122 can be relatively improved over that of the jumping-drop superhydrophobic rough surfaces.

Figure 4:
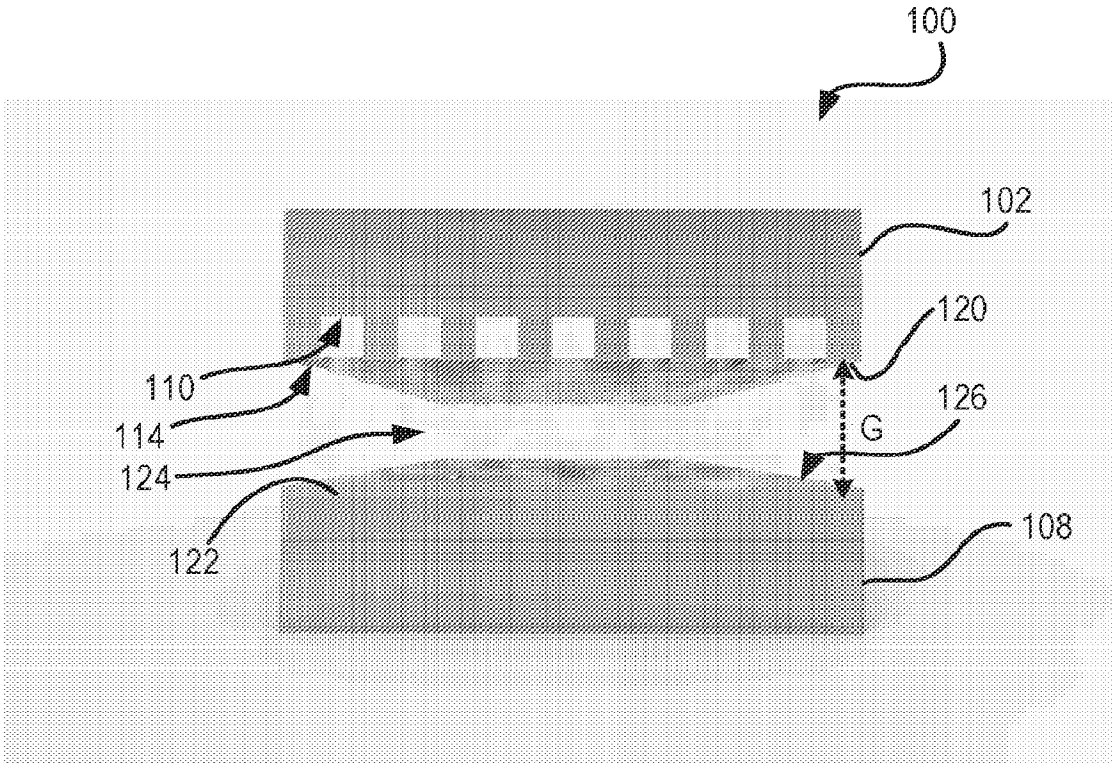
FIG. 4 shows a schematic of a side view of a portion of the thermal diode discussed above in relation to FIGS. 1-3.

FIG. 4 shows a schematic of a side view of a portion of the thermal diode discussed above in relation to FIGS. 1-3. The wick structure 114 on the first plate 102 is positioned facing the inner surface 122 of the second plate 108. The first surface 110 defining the wick structure 114 and the inner surface 122 can define a chamber 124 that accommodates a phase-change liquid 126. While not shown in FIG. 4, the chamber 124 is also defined by a separator (104, FIG. 1) that is positioned along the perimeter of the thermal diode 100. The phase-change liquid 126 is inserted into the chamber 124. The separator 104 can be a gasket that not only separates the first plate 102 from the second plate 108 but also seals the chamber 124 to enclose the phase-change liquid 126. The separator 104 can be made of plastic, rubber, metal, ceramic, or a combination thereof. The separator 104 also can be an insulator to reduce heat conduction between the plates through the separator 104. In some instances, the thermal diode 100 may include additional separators that are positioned within the perimeter of the first plate 102 and the second plate 108. For example, the thermal diode 100 may include support pillars that extend between the first plate 102 and the second plate 108 and are positioned within the chamber 124. These support pillars can improve the structural strength of the thermal diode 100.

The wick structure 114 is separated from the inner surface 122 of the second plate 108 by a gap 'G'. In particular, the gap G can be measured as the distance between the top surface 120 of the pillars 116 and the inner surface 122 of the second plate 108. As discussed further below, the gap G can be less than a capillary length of the phase-change liquid 126 within the chamber 124. In some instances, the heights of the pillars 126 may not be exactly equal throughout the wick structure 114. In such instances, the gap G can represent the average distance between the top surfaces 120 of the pillars 116 and the inner surface 122 of the second plate 108.

FIGS. 5A-5D show schematics depicting a sequence of the forward mode operation of the thermal diode. The thermal diode 100 can be operated in a forward mode and a reverse mode. The thermal diode 100 can conduct heat in the forward direction, while impeding the conduction of heat in the reverse direction. Prior to deployment of the thermal diode 100, the chamber 124 can be evacuated to remove non-condensable gasses (NCGs) that may be present within the chamber 124. Removing the NCGs can improve the efficiency of the thermal diode 100. The chamber can be filled with the phase-change liquid either before or after removing the NCGs. As an example, the phase-change liquid can include water, but other phase-change liquids can be used instead of or in addition to water, which phase-change liquids can include ethanol, methyl alcohol, propylene glycol, and refrigerants such as R141b. In some instances, the first plate 102 can be heated with a heater to accelerate evaporation of the phase-change liquid from the wick structure 114. Thereafter, the chamber 124 can be evacuated again to remove NCGs that may have been present in the phase-change liquid. The chamber 124 can be left open to the evacuating vacuum until the pressure in the chamber 124 reaches a steady-state value. At this stage, the chamber 124 primarily includes saturated phase-change liquid at saturated vapor pressure corresponding to the surrounding temperature. The chamber 124 can then be sealed off.

Figure 5A:
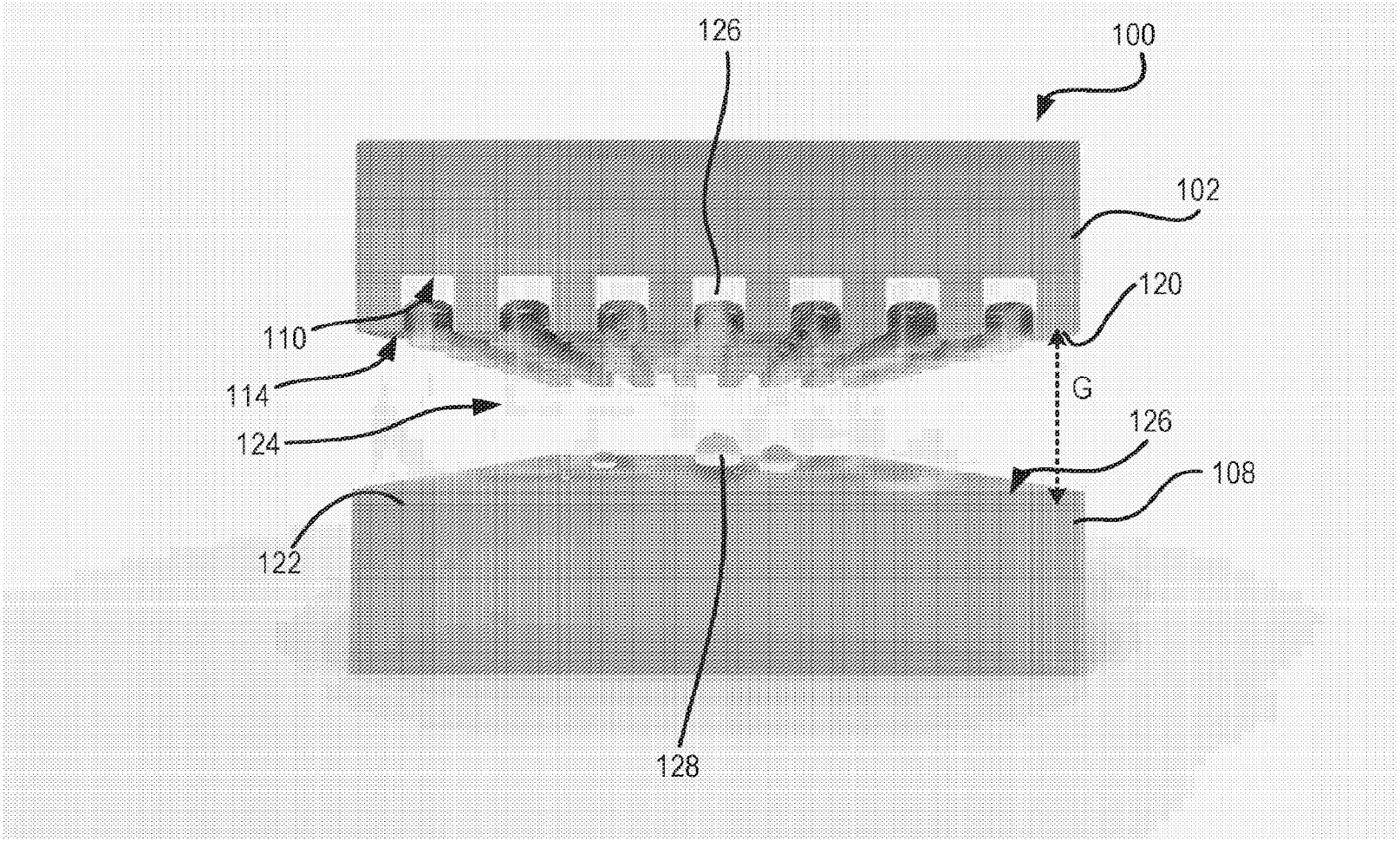
FIGS. 5A-5D show schematics depicting a sequence of the forward mode operation of the thermal diode shown in FIG. 1.
Figure 5B:
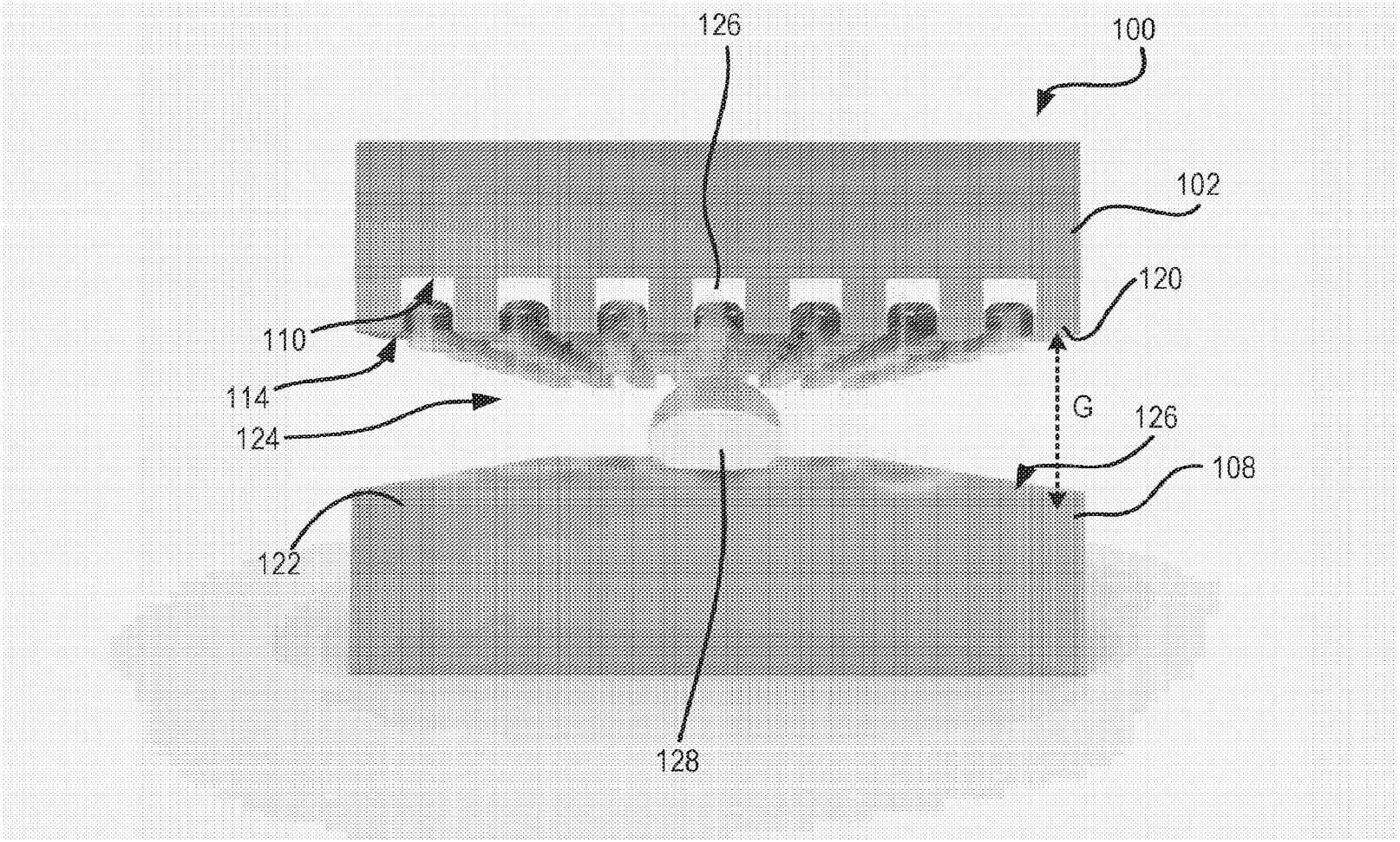
Figure 5C:
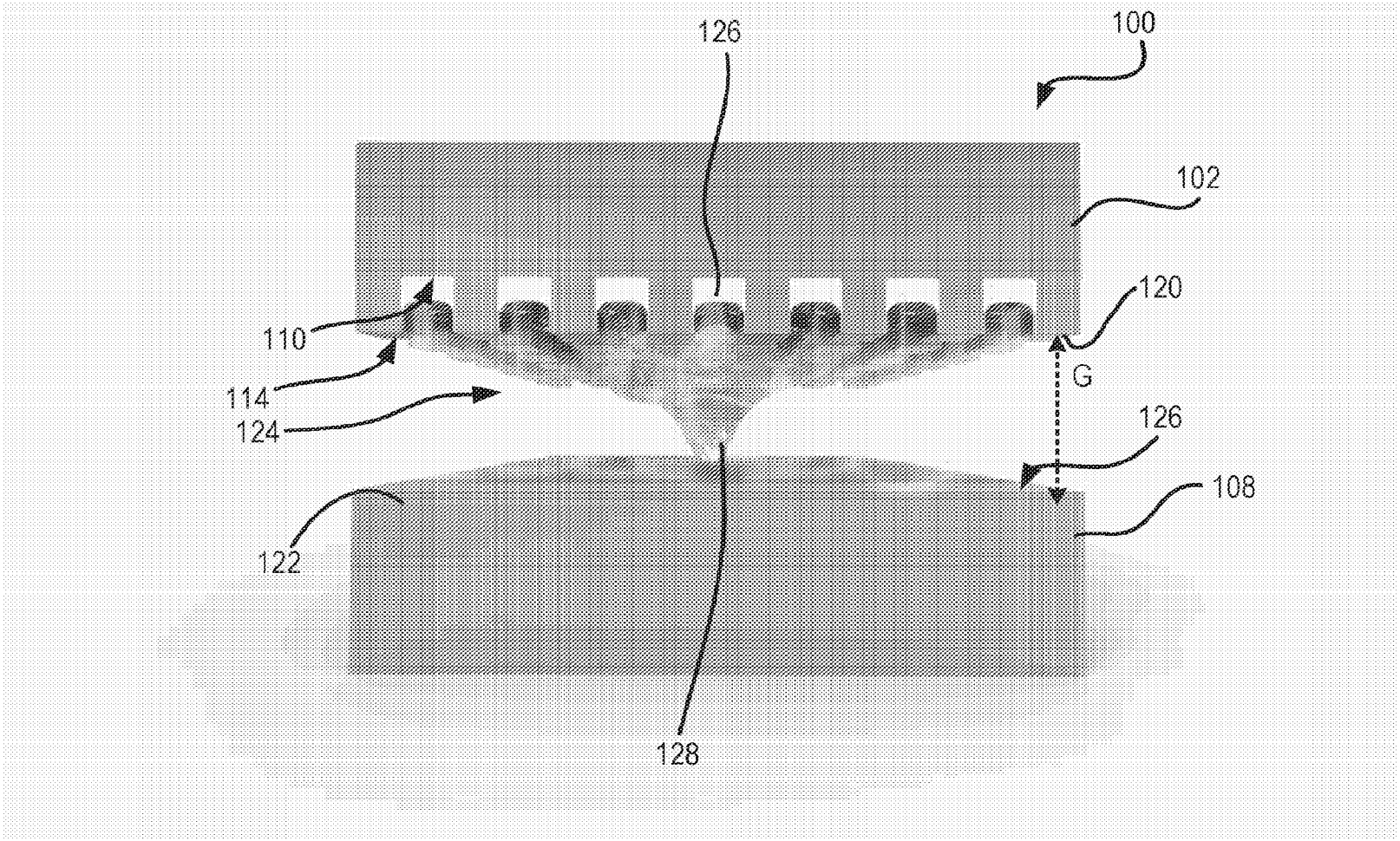
Figure 5D:
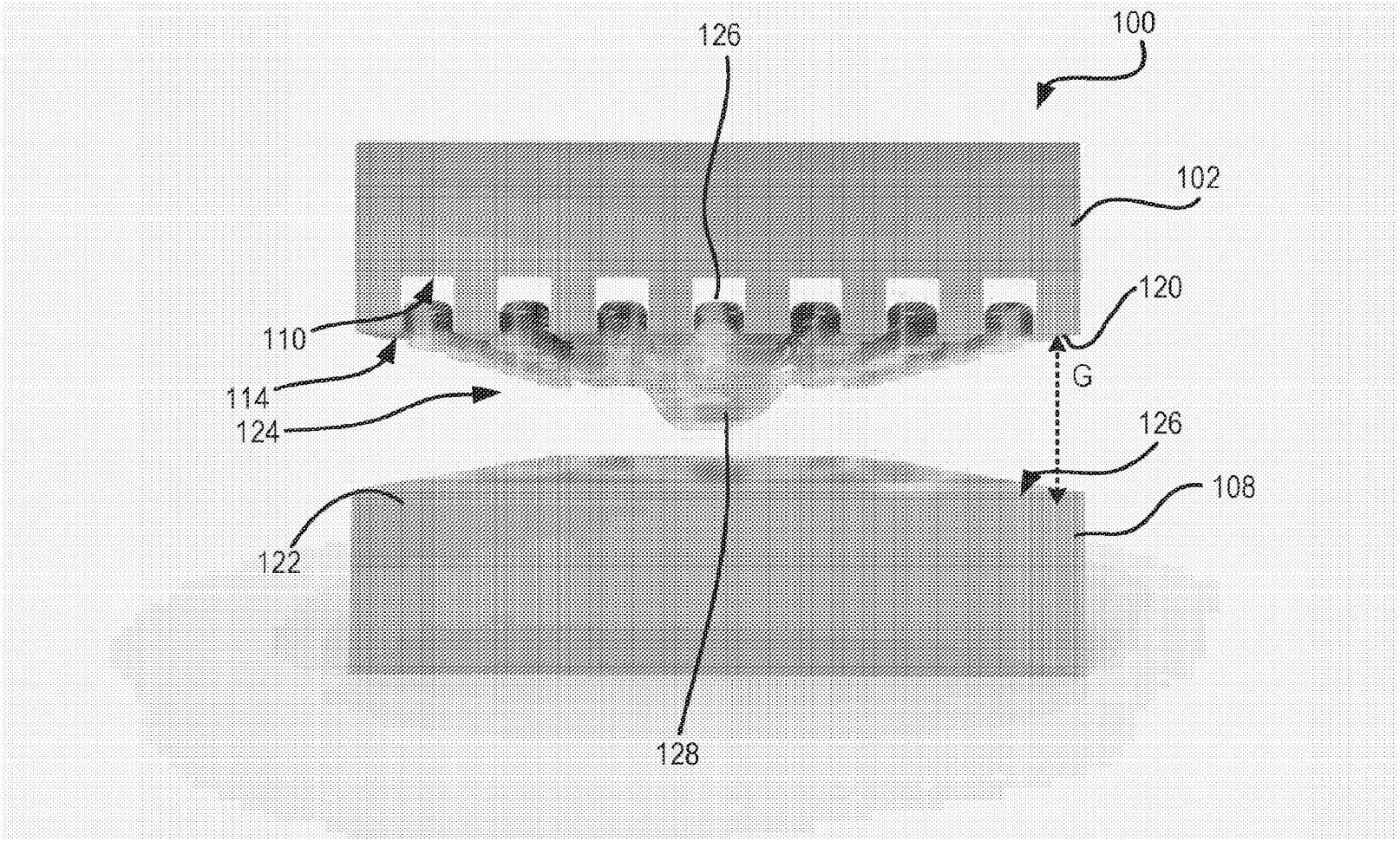

In the forward mode, the temperature at the first plate 102 is greater than the temperature at the second plate 108. For example, the thermal diode 100 would operate in the forward mode if the first plate 102 is coupled with a heat source such as, for example, an integrated circuit, and the second plate 108 is coupled with a heat sink. The heating of the first plate 102, and in turn the wick structure 114, causes the phase-change liquid within the wick structure 114 to evaporate. The vapor makes contact with the relatively cooler second plate 108. The vapor transfers the latent heat of vaporization on to the second plate 108, causing the formation of a populated region of heterogeneously nucleated embryos of liquid dew droplets 128 on the inner surface 122, as shown in FIG. 5A. With continued evaporation of the phase-change fluid from the wick structure 114, corresponding condensation on the second plate 108, and coalescence of droplets on the inner surface 122, the size of the droplets 128 increases, as shown in FIG. 5B. Further evaporation of the phase-change liquid from the wick structure 114 cause the droplet 128 size to increase even more, until the droplet 128 bridges the gap G and makes contact with the wick structure 114, as shown in FIG. 5C. As the wick structure 114 is hydrophilic, the drop 128 is pulled into the wick structure 114 by capillary action, as shown in FIG. 5D. The cycle of evaporation, transfer of latent heat onto the second plate 108, condensation, and eventual bridging of the droplet 128 back into the wick structure 114 continues as long as there is a temperature differential between the first plate 102 and the second plate 108.

The bridging of the droplet 128 from the inner surface 122 to the wick structure 114 is aided by the gap G. In particular, the gap G can be selected to be equal to or less than a critical distance, which can refer to the largest distance between the wick structure 114 and the inner surface 122 at which, when the droplet 128 condenses on the inner surface 122, the droplet 128 can grow to a height to bridge the gap G. The growth of the droplet 128 resulting from the coalescence of multiple droplets translates into the growth in the height of the droplet 128. In instances where the inner surface 122 is hydrophobic, such as where the hydrophobic coating 106 is applied to the inner surface 122, or the material properties of the second plate 108 are such that the inner surface 122 is inherently hydrophobic, the hydrophobicity of the inner surface 122 can also cause the droplet 128 to have a large contact angle (between 90 degrees to 125 degrees) with the inner surface 122, thereby further contributing to the height of the droplet 128. But the growth of the height of the droplet 128 is limited by the balance between the surface tension on the surface of the droplet 128 and gravity. For a droplet that has a radius that is less than a capillary length associated with the type of liquid forming the droplet, the growth of the droplet will translate to a great extent into the growth in the height of the droplet. The capillary length is a scaling factor that relates surface tension and gravity. For example, the capillary length of water is about 2.7 mm. Other liquids can have other capillary lengths. Having the gap G at or below the capillary length associated with the phase-change liquid, can increase the chances that the droplet 128 can grow to a height that bridges the gap G regardless of the orientation with respect to the gravitational field. In some instances, the gap G can be selected to be well below the capillary length associated with the phase-change liquid to increase the volume of the liquid that is bridged back into the wick structure 114, and thereby increase the efficiency of heat transfer from the first plate 102 to the second plate 108. For example, the gap G can be selected to be smaller than an order of magnitude less than the capillary length of the phase-change liquid. In some examples, where the phase-change liquid is water, the gap G can be selected to be about 250 μm. In some examples, the gap G for water can be about 500 μm or less, about 300 μm or less, or about 100 μm or less. The thermal diode 100 can operate even with a very small gap or even no gap between the inner surface 122 and the wick structure 114.

In some instances, the droplets 128 can bridge to the wick structure 114 even when the inner surface 122 is not hydrophobic. That is the contact angle of the droplet 128 is below 90 degrees. The lack of hydrophobicity of the inner surface 122 may increase the volume of the droplets 128 formed on the inner surface 122 required to bridge into the wick. In some such instances, the gap G can be adapted to allow for the relatively lower height (compared to the height when the inner surface 122 is hydrophobic) of the droplet 128. Thus, droplets with lower contact angles but also with lower bridging heights can return to the wick structure 114 at a comparable volume to the case of a hydrophobic inner surface 122.

In the reverse mode, the temperature at the second plate 108 is greater than the temperature at the first plate 102. This causes any phase-change liquid on the inner surface 122 to dry out. However, there is no return of phase-change liquid form the wick structure 114 to the inner surface 122. As a result, once the phase-change liquid dries out on the inner surface 122 the heat transfer based on the phase-change liquid reduces considerably.

The effectiveness of the thermal diode 100 can be expressed by its diodicity (also referred to as a rectification coefficient), which is a function of an effective thermal conductivity in the forward mode ($k_f$) to an effective thermal conductivity in the reverse mode ($k_r$). For example, the diodicity η can be described by the following equation:

$$\eta = \frac{k_f - k_r}{k_r} \tag{1}$$

The thermal diode 100 can have a diodicity of at least 10, at least 20, at least 40, or at least 60 and up to about 150 or 300 at a temperature of about 20° C. to about 90° C.

The thermal diode 100 can operate regardless of its orientation in relation to the gravitational field. As discussed above, the bridging of the droplets 128 from the inner surface 122 to the wick structure 114 occurs due to capillary action. Because of the capillary action, the operation of the thermal diode is impacted by gravity to a much lesser degree than for example the impact of gravity on the operation of the thermosyphons discussed above. In some examples, the diodicity of the thermal diode 100 varies by 25% or less with changes in orientation of the thermal diode with respect to the gravitational field.

The thermal diode 100 can be shaped in a manner that renders the device as a predominantly two-dimensional device. In some instances, an aspect ratio of the thermal diode, defined as either a length or a width over height of the thermal diode, is greater than two. The length or the width of the thermal diode 100 can be measured as the length and the width of the first plate 102 or the second plate 108. The height of the thermal diode 100 can be measured as the largest distance between the first plate 102 and the second plate 108. In some instances, the height of the thermal diode 100 can be instead represented by the gap G between the inner surface 122 and the wick structure 114, or a gap between the inner surface 122 and the first surface 110 at the bottom of the pillars 116. As an example, the thermal diode can have a length and a width in a range of about few cm to several meters, or about 3 cm to about 10 m or about 10 cm to about 1 m. The planar design of the thermal diode 100 lends itself to high degree of scalability. Therefore, a wide range of first plate 102 and second plate 108 sizes can be built and formed into a thermal diode. In some instance, where the size of the thermal diode 100 large (e.g., in meters), the thermal diode 100 can include additional support structures such as, for example, posts or pillars positioned between the plates and distributed throughout the area of the plates to reduce the risk of bowing or bending of the first plate 102 or the second plate 108 and improve the uniformity of the gap G between the plates.

The following provides a discussion of experimental results and theoretical modeling of example thermal diodes. It should be noted that the discussion below is of one or more example configurations of the thermal diode, and do not necessarily limit the scope of the claims or the scope of the examples discussed above in relation to FIGS. 1-5.

The bridging-droplet thermal diode is comprised of two opposing copper plates, one having a wick structure while the other is smooth and hydrophobic, separated by an insulating and water-resistant gasket. After sealing the chamber, water is injected into the wick structure and the NCGs are removed. In the forward mode of operation, the heat source is located on the back face of the wicked copper plate. Steam carries the latent heat across the gap and is dumped into the hydrophobic plate by dropwise condensation. The moderately large contact angles of the dew droplets enables them to bridge the gap and to wick back into the opposing evaporator for sustained phase-change heat transfer. In the reverse mode, the heat source is now located on the back face of the smooth hydrophobic plate, resulting in dryout and poor heat transfer across the vapor space. The two plates were 99.9% pure multipurpose copper (McMaster-Carr, 8963K165), of dimensions 101 mm×101 mm×6.5 mm. On the center of one plate, a 76 mm×76 mm array of micropillars was milled, where each pillar has dimensions of approximately 100 μm×100 μm×600 μm. The center-to-center pitch between adjacent pillars was 200 μm, resulting in a solid fraction of $\varphi=0.25$. Two water/vapor pathways were drilled into the other copper plate, each pathway extended from a side wall of the plate to a central portion of the front (i.e., inner) face. A short copper tube, of 0.32 mm inner diameter, was soldered to the entrance of each pathway located on the side walls to serve as ports. A hole was drilled into the side wall of both copper plates to accommodate thermistors (Omega Engineering, TH-10-44031, +/−0.1° C. accuracy). The relatively large thickness of each plate (6.5 mm) was to easily accommodate the thermistors and rudimentary port tunnels for laboratory characterization and would not be necessary for practical application. To make the smooth plate hydrophobic, it was submerged in a mixture of 2 mm of 1-hexadecanethiol (Fisher Scientific, AC120521000) in ethanol for 15 min to deposit a self-assembled monolayer. The plate was then gently cleaned by soaking in pure ethanol for 1 min and drying with nitrogen gas. Note that while the hydrophobic monolayer was sufficient for laboratory characterization, a more durable hydrophobic coating (e.g., grafted polymer or graphene) could be used for practical applications.

Prior to assembling the bridging-droplet thermal diode, the superhydrophilicity of the wicked plate was rejuvenated using a plasma cleaner (Harrick Plasma, PDC-001). A square gasket, comprised of a 101 mm×101 mm sheet of water-resistant EPDM rubber (McMaster-Carr, 8610K84), was made by cutting a 76 mm×76 mm hole in its middle to comprise the vapor space. The chamber was then bolted together using 12 glass-filled nylon screws (McMaster-Carr, 91221A685) around the perimeter of the plates. Through-holes were punched into the square gasket, such that the screws passed through both the copper plates and the gasket. The uncompressed thickness of the gasket was 1.1 mm, which reduced to H=850 μm after sealing the chamber. Considering the average pillar height of Hw=600 μm within the wick structure, this results in a vapor space of height Hv=250 μm. One of the two copper ports was connected to a digital pressure gauge (LJ Engineering, DVG-2) while the other port was connected to both a vacuum pump (Platinum, DV-142N) and a syringe using a three-way valve.

To serve as the heat source, a 101 mm×101 mm square film heater (Omega, KHA-404) was bonded to the back face of one copper plate with thermal grease (Aavid Thermalloy, 251G-ND). A cold plate attached to a recirculating chiller (Fisher Scientific, 13874647) was thermally greased and bolted to the back face of the opposing plate to serve as the heat sink. In the forward mode, the film heater was placed on the wicked plate and the cold plate on the hydrophobic plate, and vice versa for the reverse mode. The back sides of both the film heater and the cold plate were insulated with aerogel sheets (McMaster-Carr, 9590K1). In the low-conductivity reverse mode, the vapor chamber was additionally wrapped with insulating foam (McMaster-Carr, 3157T22) to reduce heat leakage into the ambient.

After the vapor chamber components were assembled, a primary vacuum was pulled to remove most of the NCGs. The absolute pressure within the chamber was about $P_{abs}\approx 8.1$ kPa after this dry vacuum. Subsequently, 3.25 mL of preboiled distilled water was injected into the chamber to saturate the wick structure. This volume was chosen as it corresponded to the smallest charging ratio where dryout did not occur even at high temperatures. The wicked plate was then subjected to a constant power of Q=50 W using the film heater and a DC power supply (Agilent, E3649A). The recirculating chiller was simultaneously turned on and set to 80° C. This initial configuration ensured the continual forward-mode evaporation of water from the wick for about 1 h, to release any remaining NCGs dissolved in the water into the vapor space. The cold plate was then decreased down to 50° C. to pull a secondary (wet) vacuum. The vapor space was left open to the vacuum pump until the pressure gauge reached a steady-state value. This implies that only saturated water remains in the chamber. By then closing off the chamber from the vacuum pump, experimental measurements could now be made with negligible NCGs. The water volume remaining in the chamber after the wet vacuum was comparable to the 2.6 mil, void volume of the wick structure. The partial loss of water volume is due to the wet vacuum and to condensation occurring within the two copper tubes. To reduce the latter effect, we reduced the length of these copper tubes and added an additional on/off valve to the copper tube connected to the pressure gauge. After the wet vacuum was completed, this valve was turned off.

The bridging-droplet thermal diode was characterized in both the forward and reverse modes, with each mode tested in two different orientations: "with gravity" (hydrophobic plate on top) or "against gravity" (wicked plate on top). Three trials Three trials were performed for each of these four possible combinations using a fixed power of Q=50 W for the film heater. For each trial, the temperature of the cold plate was varied from 20° C. to 80° C. in 10° C. increments to measure the steady-state temperature drop across the plates. Temperature measurements were monitored by a data acquisition unit (Keysight, 34972A) connected to the two thermistors.

Figure 6:
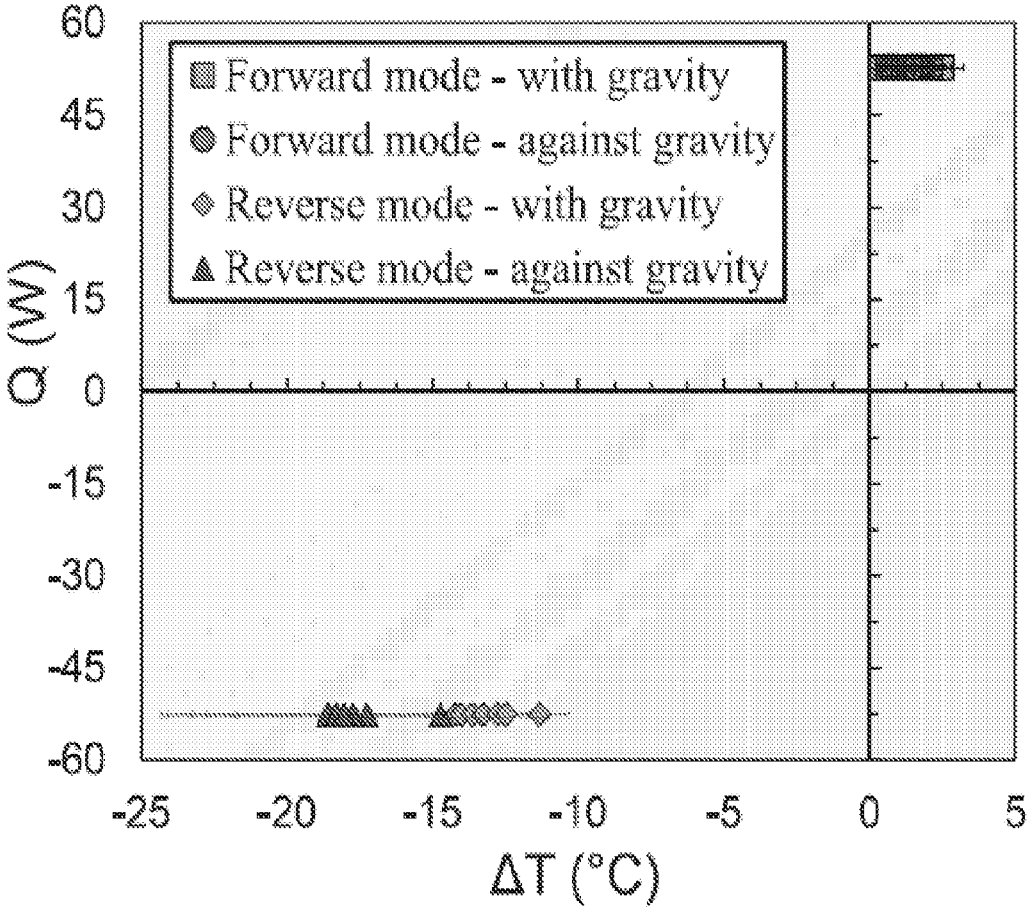
FIG. 6 shows an example plot depicting heat transfer in forward and reverse modes.

The effective temperature drop between the plates was calculated as $\Delta T=TH-TC$, where TH and TC are the temperatures of the front faces of the heated and cooled copper plates, respectively. The values of TH and TC are obtained by taking the thermistor measurements and subtracting or adding, respectively, a minor temperature drop of $(2H_pQ)/(k_{cu}A_{eff})$, where $H_p\approx 2$ mm is the distance between the center of a thermistor and the front face of its copper plate, $k_{cu}\approx 401$ W m−1 K−1 is the thermal conductivity of copper, and $A_{eff}$ is the effective cross-sectional area through which the heat transfer occurs. In the forward mode $A_{eff}\approx A_w=58$ cm^2, where $A_w$ is the cross-sectional area of the wicked evaporator, as phase-change heat transfer is dominant. Conversely, $A_{eff}\approx A_p=103.2$ cm^2 in the reverse mode, where $A_p$ is the cross-sectional area of each copper plate, as conduction across the outer gasket/screws is now appreciable due to the poor heat transfer across the vapor space. FIG. 6 shows an example plot depicting heat transfer in forward and reverse modes. In the forward mode of operation, ΔT is at least one order of magnitude lower than that of reverse mode, confirming the effectiveness of the vapor chamber as a thermal diode. Moreover, ΔT decreases with an increase in the heat sink temperature for both modes, which will be elaborated upon in our proceeding model.

The effective thermal conductivity across the chamber can be expressed by:

$$k = \frac{HQ}{A_{eff}\Delta T} \tag{2}$$

where $k=k_f$ and $A_{eff}\approx A_w$ in the forward mode, while $k=k_r$ and $A_{eff}\approx A_p$ in the reverse mode. However, the construct of an effective thermal conductivity can be somewhat misleading, as it can falsely imply that H and ΔT are directly proportional to each other. In the forward mode, there is a non-linear relationship between H and ΔT and the temperature drop across the vapor space itself is negligible (as will be seen in our model). Therefore, a more useful construct is an overall heat transfer coefficient:

$$h = \frac{Q}{A_{eff}\Delta T} \tag{3}$$

It should be noted that the same value for diodicity (η) would be obtained regardless of which construct is used, k or h.

Figure 7A:
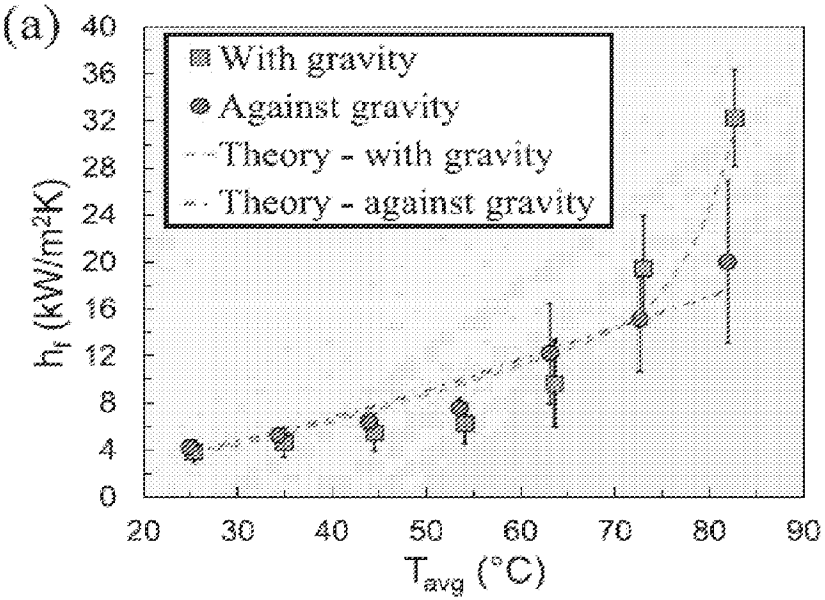
FIGS. 7A and 7B show example plots or overall heat transfer coefficient of the thermal diode as a function of average chamber temperature.
Figure 7B:
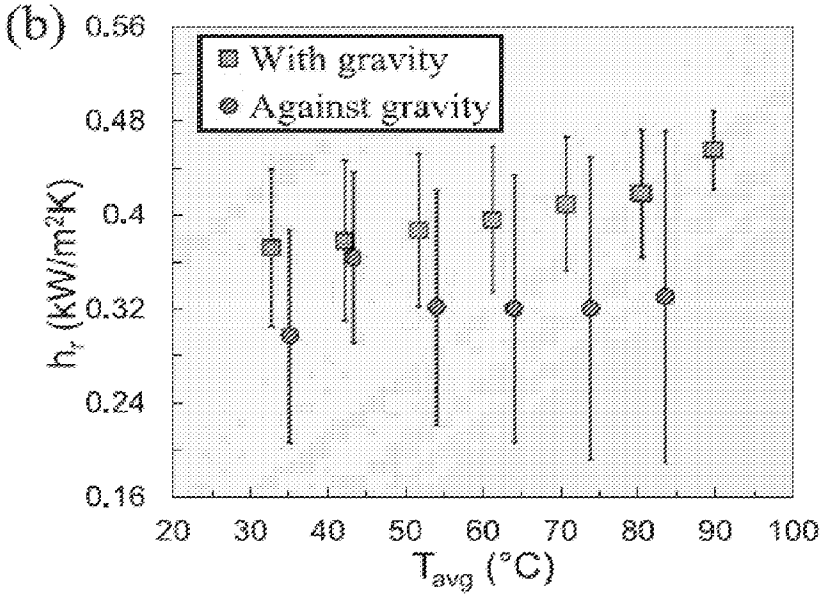

FIGS. 7A and 7B show example plots or overall heat transfer coefficient of the thermal diode as a function of average chamber temperature $T_{avg}=(T_H+T_C)/2$. For a given $T_{avg}$, the same value of $h_f$ was obtained for both chamber orientations, validating that the vapor chamber operates independently of gravity. This orientation-independence can be rationalized by the fact that the bridging-droplet radius, R≈250 μm, is an order of magnitude smaller than the capillary length: $L_c=\sqrt{\gamma/\rho g})=2.7$ mm, where γ and ρ are the surface tension and density of water, respectively. At both orientations, $h_f$ increased exponentially with the average temperature. For example, in the "with gravity" orientation, $h_f$ increased from 4 to 38 kW $m^{-2}$ $K^{-1}$ as $T_{avg}$ increased from 25 to 83° C. The orientation-independence began to break down beyond an average temperature of about 75° C., where the "with gravity" orientation now out-performed the "against gravity" one. This is most likely due to nucleate boiling beginning to occur in the wick, where the "with gravity" orientation enables the buoyant transport of bubbles across the bridging droplets to provide additional phase-change heat transfer.

Given the lack of NCGs in the system, steam should efficiently travel across the vapor space with negligible thermal resistance. Therefore, the overall heat transfer coefficient in the forward mode is governed by the three remaining sources of thermal resistance: 1) conduction resistance across the wick, 2) the interfacial resistance across the evaporating interface, and 3) the overall thermal resistance of the dropwise condensate. Therefore, the lumped resistance model for the vapor chamber in the forward mode can be expressed as:

$$\frac{1}{h_f} \approx \frac{H_w}{k_w} + \frac{1}{h_e} + \frac{1}{h_c} \tag{4}$$

where $k_w$ is the thermal conductivity of the water-saturated wick, and $h_e$ and $h_c$ are the heat transfer coefficients of the evaporating interface and condenser, respectively.

The evaporation heat transfer coefficient is estimated by:

$$h_e \approx \frac{2\hat{\alpha}}{2-\hat{\alpha}}\frac{\rho_v h_{lv}^2}{T_e}\sqrt{\frac{\overline{M}}{2\pi\overline{R}T_e}} \tag{5}$$

where $\hat{\alpha}$ is the accommodation coefficient, $\rho_v$ is the density of the saturated water vapor at the evaporating interface, $h_{lv}$ is the latent heat of vaporization, $\overline{M}$ is the molecular weight of water, $T_c$ is the water temperature at the evaporating interface (i.e., at the top of the wick), and $\overline{R}$ is the universal gas constant. The condensation heat transfer coefficient is approximated by:

$$h_c \approx \frac{1}{(T_{steam}-T_C)}\left[\int_{r_{min}}^{r_{coal}} q_d(r)n(r)dr + \int_{r_{coal}}^{r_{bridge}} q_d(r)N(r)dr\right] \tag{6}$$

where n(r) and N(r) are the size distributions of the condensates below and above the typical length scale where coalescence occurs ($r_{coal}$), $r_{min}\approx 10$ nm is the critical size of a nucleating embryo, $r_{bridge}$ is the maximum (i.e., departure) radius where bridging occurs, $T_{steam}$ is the steam temperature, and $q_d(r)$ is the heat transfer across a condensate of radius r. The coalescence radius is found from the relation $r_{coal}=1/4\sqrt{N_s}$, where $N_s$ is the nucleation density of water droplets on the substrate. For a representative nucleation density of $10^{10}$-$10^{11}$ droplets/$m^{-2}$ on a coated hydrophobic substrate, $r_{coal}$ varies from 0.8-2.5 μm. An average value of $r_{coal}\approx 1$ μm is used for the calculations here. For dropwise condensate that is approximately hemi-spherical in shape, $r_{bridge}\approx H_v\approx 250$ μm. Moreover, for the hydrophobic substrate in a horizontal or upside-down orientation, the sweeping time is assumed to be infinite (i.e., no droplet sweeping). This results in a simplified relation for the small droplet size distribution, n(r) compared to that provided by Kim et al. Thus, the final forms for n(r) and N(r) used in our model are:

$$n(r) = \frac{1}{3\pi r_{col}^3 r_{bridge}}\left(\frac{r_{col}}{r_{bridge}}\right)^{-2/3}\frac{r(r_{col}-r_{min})}{r-r_{min}}\frac{A_2 r + A_3}{A_2 r_e + A_3} \tag{7}$$

$$N(r) = \frac{1}{3\pi r^2 r_{bridge}}\left(\frac{r}{r_{bridge}}\right)^{-2/3}$$

where the constants $A_2$ and $A_3$ are the same as those defined in previous studies. The heat transfer across any given droplet, $q_d(r)$, is itself given by:

$$q_d(r) = \frac{\pi r^2\left((T_{steam}-T_C) - \frac{2T_{steam}\gamma}{r h_{lv}\rho}\right)}{\frac{1}{2h_i(1-\cos\theta)} + \frac{r\theta}{4k\sin\theta} + \frac{\delta_c}{k_c\sin^2\theta}} \tag{8}$$

Here, $h_i$ is the interfacial heat transfer coefficient about the condensate, ν≈100° is the contact angle of the condensate, k≈0.6 W $m^{-1}$ $K^{-1}$ is the thermal conductivity of water, and $\delta_c\approx 1$ nm and $k_c\approx 0.23$ W $m^{-1}$ $K^{-1}$ are the thickness and the thermal conductivity of the hydrophobic thiol monolayer, respectively. This value fork, corresponds to the reported value for liquid-phase 1-hexadecanethiol. While a self-assembled thiol monolayer may not have the exact same properties as the bulk liquid, this is nonetheless extremely close to a typical value of $k_c\approx 0.2$ W $m^{-1}$ $K^{-1}$ used to model hydrophobic monolayers in general. The expression for $h_i$ is equivalent to $h_c$ from Equation (5), except that now the temperature corresponds to $T_{steam}$.

Using Equations (4)-(8), theoretical values for $h_f$ were obtained corresponding to each experimental value for $T_H$ and $T_C$ (FIG. 7A). Values for the accommodation coefficient were chosen to best-fit the theory to the data: $\hat{\alpha}$=0.014 for the "with gravity" orientation and $\hat{\alpha}$=0.015 for the "against gravity" orientation. At these values, there is good agreement between the theoretical and experimental values for $h_f$. The fact that the best-fit values for $\hat{\alpha}$ are virtually equal for the two orientations further highlights the gravitational independence of the chamber. There is a slight discrepancy in the model for moderate values of $T_{avg}$, which could potentially be due to the simplified assumption of a fixed $\hat{\alpha}$ value. In reality, it has been reported that $\hat{\alpha}$ can decrease with increasing temperature. At the highest $T_{avg}$, the sudden boost in the experimental $h_f$ for the "with gravity" orientation was captured in the model by neglecting the conduction and interfacial resistances across the wicked evaporator. In other words, $h_f \approx h_c$ when the forward mode is boiling-enhanced in the "with gravity" orientation.

An equivalent experimental characterization of the thermal diode was performed in the reverse mode of operation, where the heat source was switched to the hydrophobic plate (FIG. 7B). The values of $h_r$ were an order of magnitude smaller than $h_f$, indicating that the water is now trapped within the wick structure preventing phase-change heat transfer. In further contrast to the forward mode, $h_r$ did not vary appreciably with average temperature. This indicates that the heat is now primarily spreading via conduction across the vapor space and gasket. Averaging over $T_{avg}$=33 to 83° C. results in mean values of $h_r$=0.39±0.02 kW $m^{-2}K^{-1}$ in the "with gravity" orientation and 0.33±0.02 kW $m^{-2}K^{-1}$ in the "against gravity" orientation. At the highest heat sink temperature employed (80° C.), $h_r$ could only be consistently measured for the "with gravity" orientation. When trying in the "against gravity" orientation, $T_H$ approached 100 □ C., which we avoided to prevent any possible damage to the hydrophobic coating. This larger temperature drop across the chamber implies that $h_r$ becomes higher in the "against gravity" orientation at high temperatures, which can likely be attributed to natural convection.

Figure 8:
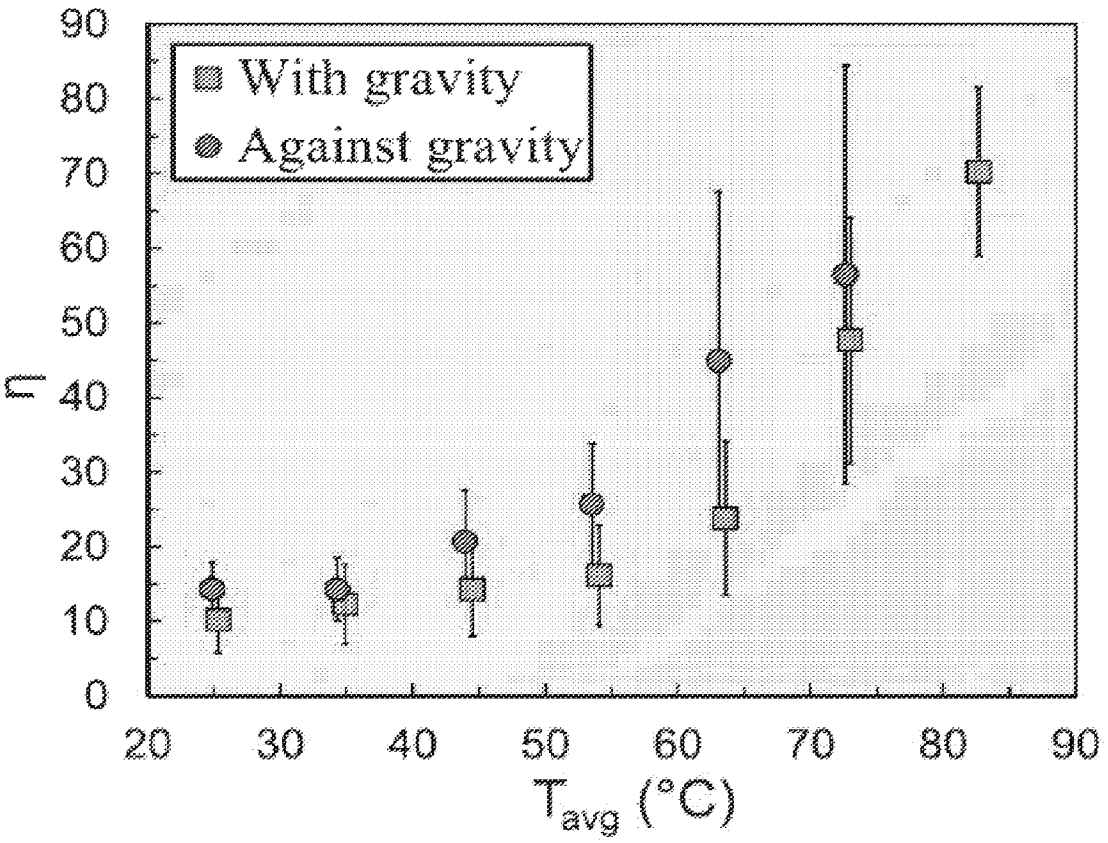
FIG. 8 shows an example plot of the diodicity of a thermal diode with respect to average temperature difference between the condenser and evaporator plates.

By comparing $h_f$ and $h_r$, diodicity of the bridging-droplet thermal diode is calculated, as shown in FIG. 8. At both chamber orientations, n increased exponentially with the vapor temperature. For example, in the "with gravity" orientation, 11 increased from 11±4 to 70±11 as $T_{avg}$ increased from 26 to 83° C. The diodicity values are also, within experimental uncertainty, unaffected by switching between the "with gravity" and "against gravity" orientations. These findings confirm that a bridging-droplet thermal diode is capable of effective and orientation-independent thermal rectification, but without requiring a superhydrophobic condenser.

The diodicity of the bridging-droplet thermal diode could be substantively improved by decreasing the height of the vapor space H, thereby decreasing the critical droplet size where bridging occurs. This would decrease the conductive losses across the dropwise condensate to enhance forward-mode performance, and therefore the diodicity. Performance can also increase by increasing a relative size of the chamber in relation to the heat source, enabling the lateral spread of phase-change heat transfer in the forward mode. Conductive losses in the forward mode could be further decreased by using a shorter wick structure. However, the height of the wick could be constrained by $H_w > H_v$, to ensure that the water evaporating from the wick is of sufficient volume to grow condensate large enough for bridging to occur. The evaporation and condensation interfacial resistances can decrease strongly with increasing heat flux. Here, the heat flux was only q≈0.86 W $cm^{-2}$, in contrast to many real-life systems where q≥10 W $cm^{-2}$. Therefore, in practical applications the diodicity value can be much higher, for example to about 300. For electronics cooling, the reverse mode of operation is only needed for stacked CPU systems. However, the forward mode alone is still very attractive for cooling a single CPU, due to the direct liquid-return pathway to hotspots.

The discussion herein describes several aspects of the display device that can be implemented separately or in combination with other aspects of the disclosure without departing from the disclosure. The following lists a non-limiting set of aspects of the display device should not be confused with the claims.

Aspect 1: This aspect includes a thermal diode including a smooth condensing surface, a wicked evaporating surface substantially parallel to the condensing surface, where the wicked evaporating surface and the condensing surface are separated by a predetermined distance to form a chamber therebetween, and a phase-change liquid within the chamber. The predetermined distance between the wicked evaporating surface and the condensing surface is less than or equal to a critical distance, where the critical distance is defined as the largest distance between the wicked evaporating surface and the condensing surface at which, when a droplet of the phase-change liquid condenses on the condensing surface, the droplet can grow to a height to bridge the gap between the wicked evaporating surface and the condensing surface.

Aspect 2: The thermal diode according to any one of Aspects 1-15, further including an insulating gasket separating the wicked evaporating surface and the condensing surface and defining the predetermined distance therebetween and forming insulating walls on edges of the chamber.

Aspect 3: The thermal diode according to any one of Aspects 1-15, wherein one or both of the wicked evaporating surface and the condensing surface comprise copper, silicon, aluminum, steel, titanium, or a combination thereof.

Aspect 4: The thermal diode according to any one of Aspects 1-15, wherein the phase change liquid comprises water or a mixture thereof.

Aspect 5: The thermal diode according to any one of Aspects 1-15, wherein the smooth condensing surface comprises a hydrophobic coating.

Aspect 6: The thermal diode according to any one of Aspects 1-15, wherein the hydrophobic coating comprises a hydrophobic thiol coating or a hydrophobic polymer coating.

Aspect 7: The thermal diode according to any one of Aspects 1-15, wherein the smooth condensing surface has a surface roughness about 5 nm, about 1 nm, about 0.5 nm, or less.

Aspect 8: The thermal diode according to any one of Aspects 1-15, wherein the wicked evaporating surface comprises a plurality of micro-scale pillars, micro-scale dimples, a micro-mesh, or a sintered copper surface.

Aspect 9: The thermal diode according to any one of Aspects 1-15, wherein the thermal diode has a diodicity of at least 10, at least 20, at least 40, or at least 60 and up to about 150 or 300 at a temperature of about 20° C. to about 90° C.

Aspect 10: The thermal diode according to any one of Aspects 1-15, wherein a diodicity of the thermal diode varies by 25% or less with changes in orientation of the thermal diode in relation to the gravitational field.

Aspect 11: The thermal diode according to any one of Aspects 1-15, wherein a shortest straightline distance between the smooth condensing surface and the wicked evaporating surface is about 500 μm or less, about 300 μm or less, or about 100 μm or less.

Aspect 12: The thermal diode according to any one of Aspects 1-15, wherein the thermal diode has an aspect ratio defined as either a length or a width over a height of greater than 2, such that the thermal diode is essentially two-dimensional.

Aspect 13: The thermal diode according to any one of Aspects 1-15, wherein the gasket provides fluidic sealing of the chamber and prevents or reduces thermal conduction during operation of the thermal diode.

Aspect 14: The thermal diode according to any one of Aspects 1-15, wherein the thermal diode is attached to a body selected from at least one of an electronic device, a biological system, a medical implant, a dwelling, a construction material, a window, a motorized land or water vehicle, a satellite, an aerospace vehicle, a spacecraft, a chemical processing plant, a power plant, a mechanical machine, an electromechanical system, an energy harvesting device, a nuclear reactor, and an energy storage system.

Aspect 15: A method of rectifying heat flow, the method comprising providing a thermal diode according to any preceding claim.

Aspect 16: This aspect includes a thermal diode including a first plate having a first surface defining a wick structure, a second plate having a smooth surface facing the wick structure, the smooth surface and the wick structure defining a chamber for accommodating a phase-change liquid, and a separator positioned between the first plate and the second plate to separate the wick structure from the smooth surface by a gap that is less than a capillary length of the phase-change liquid.

Aspect 17: The thermal diode according to any one of Aspects 16-38, wherein the separator is a gasket that seals the chamber and that extends along the perimeters of the first plate and the second plate.

Aspect 18: The thermal diode according to any one of Aspects 16-38, wherein the gap is less than an order of magnitude less than the capillary length.

Aspect 19: The thermal diode according to any one of Aspects 16-38, wherein the smooth surface comprises a hydrophobic coating.

Aspect 20: The thermal diode according to any one of Aspects 16-38, wherein the hydrophobic coating comprises a hydrophobic thiol coating or a hydrophobic polymer coating.

Aspect 21: The thermal diode according to any one of Aspects 16-38, wherein the smooth surface is devoid of nanostructures that have a height of more than 100 nm.

Aspect 22: The thermal diode according to any one of Aspects 16-38, wherein the smooth surface is devoid of nanostructures that have a pitch of more than 500 nm.

Aspect 23: The thermal diode according to any one of Aspects 16-38, wherein the wick structure includes an array of pillars.

Aspect 24: The thermal diode according to any one of Aspects 16-38, wherein a height of the array of pillars is 400 μm to 800 μm.

Aspect 25: The thermal diode according to any one of Aspects 16-38, wherein an average center-to-center pitch between adjacent pillars in the array of pillars is 100 μm to 300 μm.

Aspect 26: The thermal diode according to any one of Aspects 16-38, wherein a plurality of pillars from the array of pillars have a rectangular cross-section.

Aspect 27: The thermal diode according to any one of Aspects 16-38, wherein a plurality of pillars from the array of pillars have a circular cross-section.

Aspect 28: The thermal diode according to any one of Aspects 16-38, wherein the wick structure includes a sintered first surface.

Aspect 29: The thermal diode according to any one of Aspects 16-38, wherein the gap has a magnitude that allows for a condensed droplet of the phase-change liquid on the smooth surface to grow to a height to bridge between the smooth surface and the wick structure.

Aspect 30: The thermal diode according to any one of Aspects 16-38, wherein the condensed droplet has a contact angle that is greater than 90 degrees but less than 125 degrees.

Aspect 31: The thermal diode according to any one of Aspects 16-38, wherein the gap has a magnitude of up to 350 μm.

Aspect 32: The thermal diode according to any one of Aspects 16-38, wherein in a forward mode of operation, the first plate is thermally coupled with a heat source.

Aspect 33: The thermal diode according to any one of Aspects 16-38, wherein in a reverse mode of operation, the second plate is thermally coupled with a heat source.

Aspect 34: The thermal diode according to any one of Aspects 16-38, wherein one or both of the wick structure and the smooth surface comprise copper, silicon, aluminum, steel, or a combination thereof.

Aspect 35: The thermal diode according to any one of Aspects 16-38, wherein the phase-change liquid comprises water or a mixture thereof.

Aspect 36: The thermal diode according to any one of Aspects 16-38, wherein the smooth surface has a surface roughness about 5 nm, about 1 nm, about 0.5 nm, or less.

Aspect 37: The thermal diode according to any one of Aspects 16-38, wherein the thermal diode has a diodicity of at least 10, at least 20, at least 40, or at least 60 and up to about 150 or 300 at a temperature of about 20° C. to about 90° C.

Aspect 38: The thermal diode according to any one of Aspects 16-38, wherein a diodicity of the thermal diode varies by 25% or less with changes in orientation of the thermal diode in relation to the gravitational field.

References: All cited references, patent or literature, are incorporated by reference in their entirety. The examples disclosed herein are illustrative and not limiting in nature. Details disclosed with respect to the methods described herein included in one example or embodiment may be applied to other examples and embodiments. Any aspect of the present disclosure that has been described herein may be disclaimed, i.e., exclude from the claimed subject matter whether by proviso or otherwise.

[1] G. Wehmeyer, T. Yabuki, C. Monachon, J. Wu, C. Dames, Appl. Phys. Rev. 2017, 4, 041304.

[2] J. Oh, P. Birbarah, T. Foulkes, S. L. Yin, M. Rentauskas, J. Neely, R. C. N. Pilawa-Podgurski, N. Miljkovic, Appl. Phys. Lett. 2017, 110, 123107.

[3] K. F. Wiedenheft, H. A. Guo, X. Qu, J. B. Boreyko, F. Liu, K. Zhang, F. Eid, A. Choudhury, Z. Li, C. H. Chen, Appl. Phys. Lett. 2017, 110, 141601.

[4] T. Liu, J. W. Palko, J. S. Katz, E. M. Dede, F. Zhou, M. Asheghi, K. E. Goodson, Appl. Phys. Lett. 2019, 115, 254102.

[5] M. Groll, W. D. Munzel, W. Supper, J. Spacecraft 1979, 16, 195.

[6] D. W. Hengeveld, M. M. Mathison, J. E. Braun, E. A. Groll, HVAC&R Res. 2010, 16, 189.

[7] C. Marucha, J. Mucha, J. Rafalowicz, Phys. Status Solidi A 1975, 31, 269.
[8] E. Pallecchi, Z. Chen, G. E. Fernandes, Y. Wan, J. H. Kim, J. Xu, Mater. Horiz. 2015, 2, 125.
[9] M. A. dos Santos Bernardes, Int. J. Heat Mass Transfer 2014, 73, 354.
[10] C. Y. Tso, C. Y. H. Chao, Int. J. Heat Mass Transfer 2016, 93, 605.
[11] A. Jezowski, J. Rafalowicz, Phys. Status Solidi A 1978, 47, 229.
[12] D. Sawaki, W. Kobayashi, Y. Morita, I. Terasaki, Appl. Phys. Lett. 2011, 98, 081915.
[13] C. Dames, ASME J. Heat Transfer 2009, 131, 061301.
[14] J. B. Boreyko, Y. Zhao, C. H. Chen, Appl. Phys. Lett. 2011, 99, 234105.
[15] D. Reay, P. Kew, Heat Pipes, Butterworth-Heinemann, Waltham, MA 2006.
[16] A. A. Mohamad, Sol. Energy 1997, 61, 211.
[17] W. Chun, Y. J. Ko, H. J. Lee, H. Han, J. T. Kim, K. Chen, Sol. Energy 2009, 83, 409.
[18] M. Y. Wong, B. Traipattanakul, C. Y. Tso, C. Y. H. Chao, H. Qiu, Int. J. Heat Mass Transfer 2019, 138, 173.
[19] J. Supowit, T. Heflinger, M. Stubblebine, I. Catton, Appl. Therm. Eng. 2016, 101, 770.
[20] A. Faghri, Heat Pipe Science and Technology, Taylor & Francis, London, 1995.
[21] S. Varga, A. C. Oliveira, C. F. Afonso, Energy Build. 2002, 34, 227.
[22] K. Baraya, J. A. Weibel, S. V. Garimella, Int. J. Heat Mass Transfer 2020, 148, 119135.
[23] J. B. Boreyko, C. H. Chen, Int. J. Heat Mass Transfer 2013, 61, 409.
[24] T. Foulkes, J. Oh, P. Sokalski, L. Li, S. Sett, J. Sotelo, X. Yan, R. Pilawa-Podgurski, A. Castaneda, M. Steinlauf, N. Miljkovic, Appl. Phys. Lett. 2020, 116, 203701.
[25] A. Pugsley, A. Zacharopoulos, J. D. Mondol, M. Smyth, Int. J. Heat Mass Transfer 2019, 144, 118660.
[26] J. B. Boreyko, C. H. Chen, Phys. Rev. Lett. 2009, 103, 184501.
[27] T. Foulkes, S. Sett P. Sokalski, J. Oh, N. Miljkovic, Appl. Phys. Lett. 2020, 116, 093701.
[28] D. Torresin, M. K. Tiwari, D. D. Col, D. Poulikakos, Langmuir 2013, 29, 840.
[29] A. T. Paxson, J. L. Yague, K. K. Gleason, K. K. Varanasi, Adv. Mater. 2014, 26, 418.
[30] D. J. Preston, D. L. Mafra, N. Miljkovic, J. Kong, E. N. Wang, Nano Lett. 2015, 15, 2902.
[31] R. Enright, N. Miljkovic, A. Al-Obeidi, C. V. Thompson, E. N. Wang, Langmuir 2012, 28, 14424.
[32] E. Olceroglu, M. McCarthy, ACS Appl. Mater. Interfaces 2016, 8, 5729.
[33] T. Foulkes, J. Oh, R. Pilawa-Podgurski, N. Miljkovic, Int. J. Heat Mass Transfer 2019, 133, 1154.
[34] J. W. Rose, Proc. Inst. Mech. Eng., A 2002, 216, 115.
[35] V. P. Carey, Liquid-Vapor Phase-Change Phenomena, 2nd ed., CRC Press, Boca Raton, FL 2007.
[36] E. J. Le Fevre, J. W. Rose, In Proc. of the Third Int. Heat Transfer Conf., Chicago, IL, August 1966, pp. 362-375.
[37] S. Kim, K. J. Kim, J. Heat Transfer 2011, 133, 081502.
[38] N. Miljkovic, R. Enright, E. N. Wang, J. Heat Transfer 2013, 135, 111004.
[39] N. Miljkovic, R. Enright, E. N. Wang, ACS Nano 2012, 6, 1776.
[40] C. L. Yaws, Transport Properties of Chemicals and Hydrocarbons, Gulf Professional Publishing, Houston, TX 2009.
[41] R. Marek, J. Straub, Int. J. Heat Mass Transfer 2001, 44, 39.
[42] T. Semenic, I. Catton, Int. J. Heat Mass Transfer 2009, 52, 5113.
[43] I. Mudawar, IEEE Trans. Compon. Packag. Manuf. Technol. 2001, 24, 122.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein, but are to be accorded the widest scope consistent with this disclosure, the principles and the novel features disclosed herein.

What is claimed is:

1. A thermal diode, comprising:

a smooth condensing surface;

a wicked evaporating surface substantially parallel to the condensing surface, wherein the wicked evaporating surface and the condensing surface are separated by a predetermined distance to form a chamber therebetween; and a phase-change liquid within the chamber, wherein the predetermined distance between the wicked evaporating surface and the condensing surface is less than or equal to a critical distance, and wherein the critical distance is defined as the largest distance between the wicked evaporating surface and the condensing surface at which, when a droplet of the phase-change liquid condenses on the condensing surface, the droplet can grow to a height to bridge a gap between the wicked evaporating surface and the condensing surface.

2. The thermal diode according to claim 1, further comprising an insulating gasket separating the wicked evaporating surface and the condensing surface and defining the predetermined distance therebetween and forming insulating walls on edges of the chamber.

3. The thermal diode according to claim 2, wherein one or both of the wicked evaporating surface and the condensing surface comprise copper, silicon, aluminum, steel, titanium, or a combination thereof.

4. The thermal diode according to claim 1, wherein the phase change liquid comprises water or a mixture thereof.

5. The thermal diode according to claim 1, wherein the smooth condensing surface comprises a hydrophobic coating.

6. The thermal diode according to claim 5, wherein the hydrophobic coating comprises a hydrophobic thiol coating or a hydrophobic polymer coating.

7. The thermal diode according to claim 1, wherein the smooth condensing surface has a surface roughness about 5 nm, about 1 nm, about 0.5 nm, or less.

8. The thermal diode according to claim 1, wherein the wicked evaporating surface comprises a plurality of micro-scale pillars, micro-scale dimples, a micro-mesh, or a sintered copper surface.

9. The thermal diode according to claim 1, wherein the thermal diode has a diodicity of at least 10, at least 20, at least 40, or at least 60 and up to about 150 or 300 at a temperature of about 20° C. to about 90° C.

10. The thermal diode according to claim 1, wherein a diodicity of the thermal diode varies by 25% or less with changes in orientation of the thermal diode in relation to the gravitational field.

11. The thermal diode according to claim 1, wherein a shortest straightline distance between the smooth condensing surface and the wicked evaporating surface is about 500 μm or less, about 300 μm or less, or about 100 μm or less.

12. The thermal diode according to claim 1, wherein the thermal diode has an aspect ratio defined as either a length or a width over a height of greater than 2, such that the thermal diode is essentially two-dimensional.

13. The thermal diode according to claim 2, wherein the insulating gasket provides fluidic sealing of the chamber and prevents or reduces thermal conduction during operation of the thermal diode.

14. The thermal diode according claim 1, wherein the thermal diode is attached to a body selected from at least one of an electronic device, a biological system, a medical implant, a dwelling, a construction material, a window, a motorized land or water vehicle, a satellite, an aerospace vehicle, a spacecraft, a chemical processing plant, a power plant, a mechanical machine, an electromechanical system, an energy harvesting device, a nuclear reactor, and an energy storage system.

15. A method of rectifying heat flow, the method comprising providing a thermal diode according to claim 1.

* * * * *